United States Patent [19]

Williams

[11] Patent Number: 4,510,894

[45] Date of Patent: Apr. 16, 1985

[54] CAM OPERATED ENGINE

[76] Inventor: Gerald J. Williams, R.R. #2, Nolalu, Canada

[21] Appl. No.: 367,244

[22] Filed: Apr. 12, 1982

[51] Int. Cl.[3] ..... F02B 75/26

[52] U.S. Cl. ..... 123/48 R; 123/55 R; 123/58 A; 123/48 AA; 123/78 AA

[58] Field of Search ..... 123/48 R, 48 A, 48 AA, 123/48 D, 58 R, 58 A, 58 AA, 55 R, 55 A, 55 AA, 54 R, 54 A, 54 B, 78 R, 78 A, 78 AA, 78 D, 68, 39

[56] References Cited

U.S. PATENT DOCUMENTS

| | | | |
|---|---|---|---|
| 1,528,164 | 3/1925 | Nordwick | 123/55 AA |
| 1,559,301 | 10/1925 | Barnard | 123/68 |
| 2,399,743 | 5/1946 | Kahl | 123/58 R |
| 2,444,108 | 6/1948 | Norton | 123/48 AA |
| 2,770,140 | 11/1956 | Palumbo | 123/58 AM |
| 2,970,581 | 2/1961 | Georges | 123/48 A |
| 3,673,991 | 7/1972 | Winn | 123/58 A |
| 4,040,400 | 8/1977 | Kiener | 123/68 |
| 4,300,486 | 11/1981 | Lowther | 123/39 |

FOREIGN PATENT DOCUMENTS

| | | | |
|---|---|---|---|
| 563891 | 9/1958 | Canada | 123/48 |

*Primary Examiner*—Craig R. Feinberg
*Assistant Examiner*—David A. Okonsky

[57] ABSTRACT

A cam operated internal combustion engine of piston type positive displacement variety, having novel piston-to-cam connecting means. The pistons are cam operated to optimize the aspiration, combustion and expansion process. Executed in axial and radial cam versions, with alternatively a two cycle, four cycle or novel three cycle mode of operation. The arrangements provide advantages in manufacturing and construction, as well as improved thermal efficiencies.

3 Claims, 43 Drawing Figures

C-C

A-A

B-

D-

E-

F-
G-

H-

I-

J-J

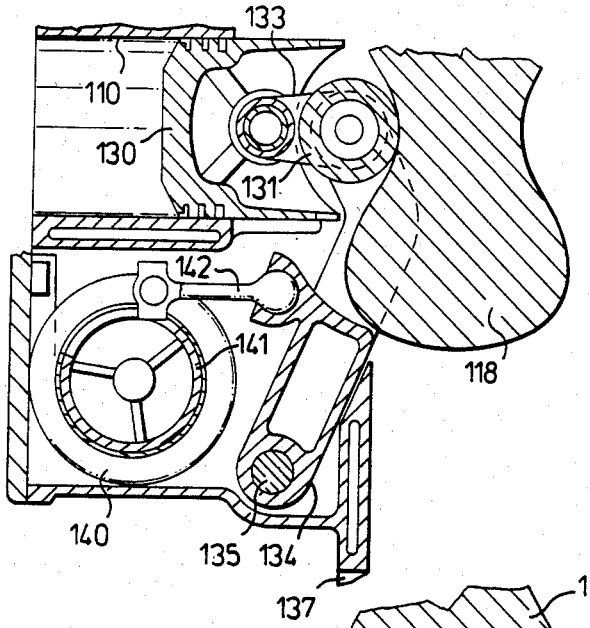
FIG. 26a.
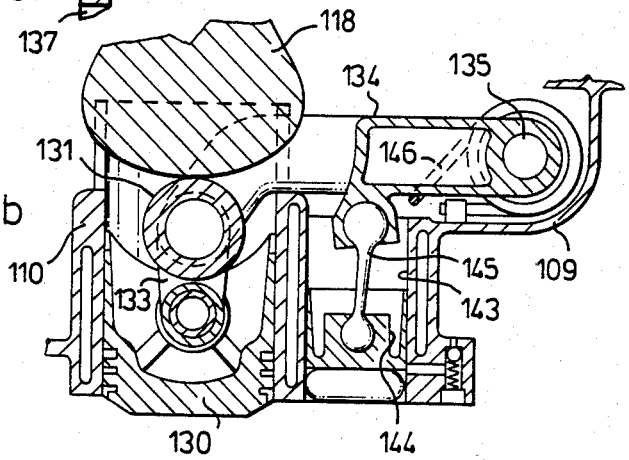
FIG. 26b
FIG. 26c.
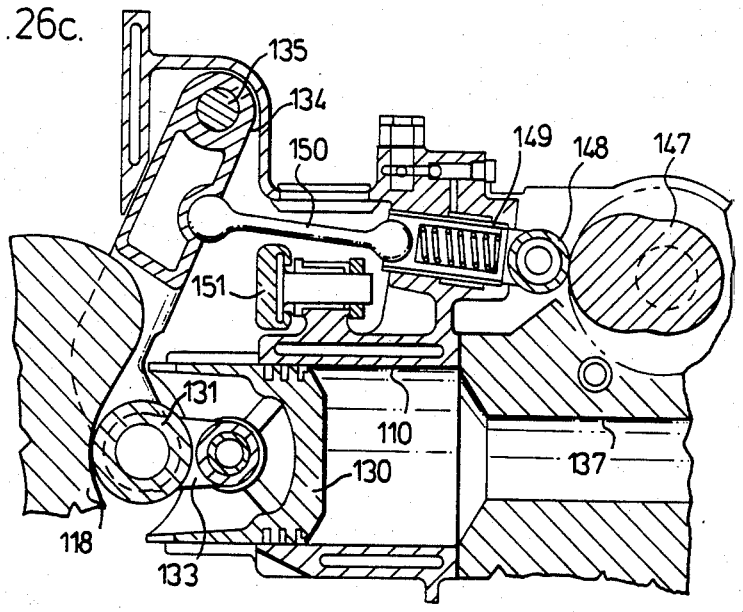

N-N

P-P

CAM OPERATED ENGINE

FIELD OF THE INVENTION

This invention relates to piston type cam operated internal combustion engines having improved piston-to-cam connecting means, and improved design features.

BACKGROUND OF THE INVENTION

It is known in the art relating to design of machinery that often optimum efficiency results if each major component is designed to carry out one specific function. The multitude of functions carried out by the piston and combustion chamber in conventional piston type internal combustion engines demands compromises which severely limit the efficiency of each of the cycles which make up the overall process. Reference is made to our co-pending Canadian application No. 378-226-3; filed 81-05-25; entitled—"Three Cycle Engine with Varying Combustion Chamber Volume" for a description of the novel three cycle process engine, wherein the charge preparation processes are separated from the combustion expansion and exhaust expulsion processes and optimized, said three cycle process comprising three distinct cycles within the combustion chamber, the cycles being: the high pressure charging cycle with the piston generally near the top position of its stroke, immediately followed by the combustion and expansion cycle, carrying the piston downward, followed by the positive exhaust expulsion cycle, carried out during the greater portion of the subsequent upstroke of the piston; the high pressure charge admitted under constant density regardless of power output and pre-compressed by a separate charge pre-compressor; the power output being varied as required by adjusting the initial pre-combustion volume of the combination chamber, on the run. The above novel process may advantageously utilize cam operated engines, since a cam may retain the piston stationary in the top position while high pressure charging and combustion takes place. In order to enhance the mechanical arrangement of cam operated versions of the above invention, the present invention provides improved detail embodiments, specifically in the piston to cam connecting means.

Reference is also made to our co-pending Canadian application No. 395723; filed 82-02-08; entitled—"An Internal Combustion Engine With Improved Expansion Ratio" for a description of an internal combustion engine and a miniature reciprocating cylinder head and novel poppet sleeve valves; for use in said engine, to improve the aspiration cycles and expansion ratios. Said novel mini reciprocating cylinder head defines a miniature cylinder bore, axially in line with the main cylinder bore, and reciprocally carrying a piston shaped component, facing downwardly, comprising said mini reciprocating cylinder head. Said head is flexibly biased downwardly to reduce the combustion chamber to extremely small volume during aspiration, greatly enhancing aspiration, with the charge pressure in the combustion chamber subsequently driving said head upwardly to seat against an on-the-run adjustable upper travel limiter, thereby effectively varying the combustion chamber volume. The variation in combustion chamber volume maintains the charge of maximum permissible density, regardless of the mass of the charge admitted, resulting in improved thermal efficiencies due to improved expansion ratios at reduced charge intakes.

Said novel poppet sleeve valves comprise valves shaped as cylindrical sleeves, for reciprocative guidance, with inward or outward directed seatable flanges, comprising the valve head. This construction allows coaxial disposal of several valves and/or above said mini reciprocating cylinder head, for improved aspiration, stratified charging and/or symmetrical combustion.

The present invention advantageously uses above improvements in novel improved embodiments, although the desirable properties of above designs are retained. Specifically the actuating means for a valve carried by said mini reciprocating cylinder head is improved in the present invention.

SUMMARY OF THE INVENTION

The present invention provides engine arrangements using a coaxial or radial cam to operate the pistons, with novel piston to cam connecting means, giving lower engine profile, greatly reduced piston friction and wear due to elimination of practically all side thrust, lower manufacturing cost and improved longevity. Contrary to crankshaft operated engines, cam operation depends on the wedge principle, the wedge being a roller driven between the inclined surface of the cam and a "vertical" reaction surface. The present invention provides a novel thrust radius arm to take all torque reactions, reducing manufacturing costs, improving longevity and practically eliminating friction due to torque reaction. The usual flanged construction of the cam, with the main cam roller riding on top of the flange and a smaller cam follower roller disposed below the flange, is eliminated and replaced by a simpler to manufacture, more rugged cam, with alternative "cam following" means or piston return means provided, with the important side benefits of lowered engine profile and, in some cases, automatic, or externally adjustable, cam roller play take-up.

The engine arrangements of the present invention utilize the novel miniature reciprocating cylinder head as outlined previously, with a novel, simplified actuating means for the charge admission valve carried by said miniature head. By utilizing three coaxial valves, two concentric inlet valves and one concentric exhaust valve, strongly stratified, coaxial charge admission may be achieved, whereby a coaxial blanket of pure air may surround the central charge trapped in the actual miniature combustion chamber; it is believed that the coaxial blanket of pure air will slow heat losses to the cylinder walls and improve emission by providing excess air, yet allow strong combustion. These and other features and advantages of the invention will be more fully understood from the following description of preferred embodiments taken together with the accompanying drawings.

BRIEF DESCRIPTION OF THE DRAWINGS

In the drawings:

FIGS. 26*a*, 26*b* and 26*c* show alternative piston return means, allowing an extremely compact and rugged radial cam;

DESCRIPTION OF THE ILLUSTRATED EMBODIMENTS

Figure 1:
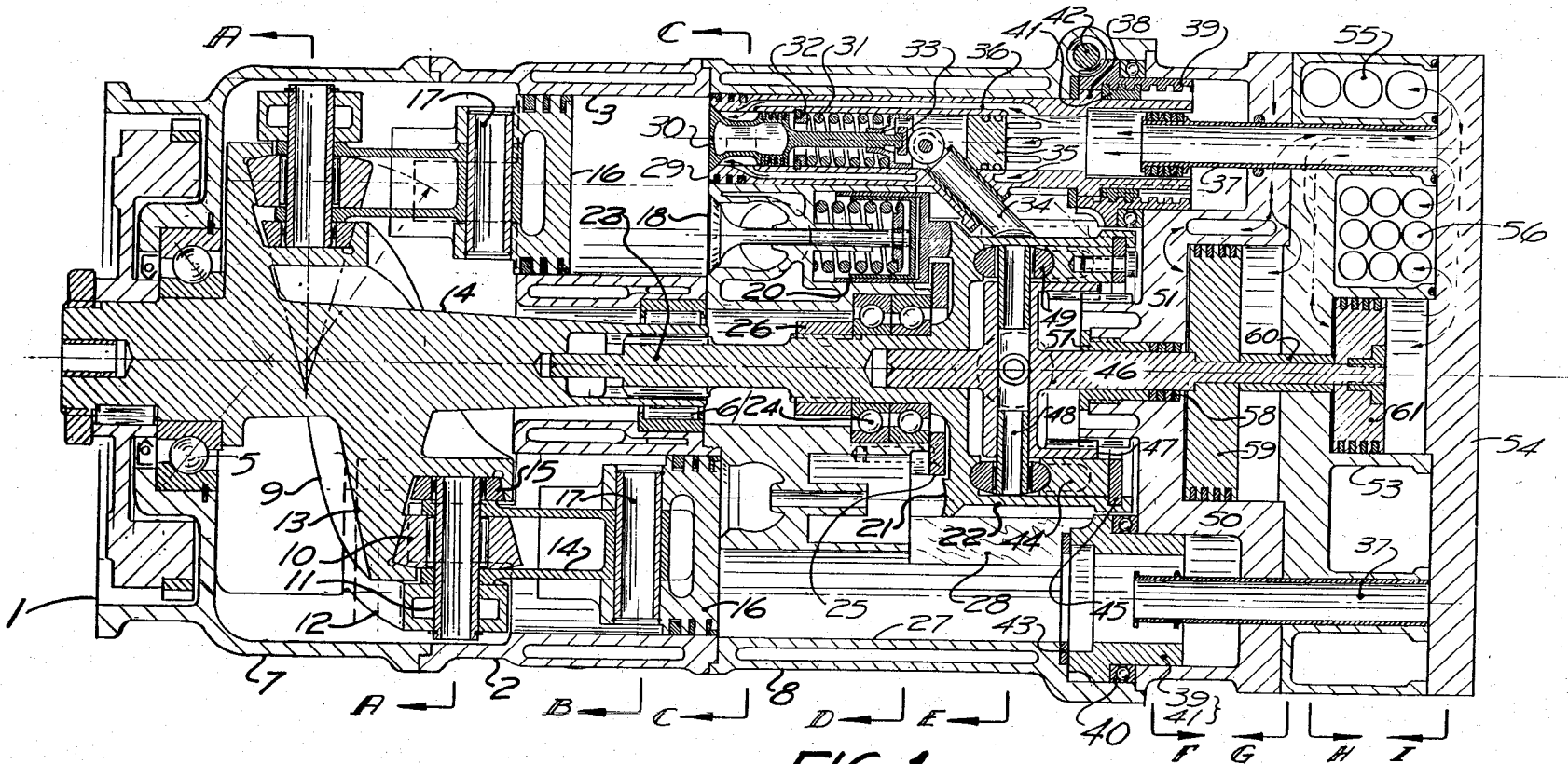
FIG. 1 is a cross section on the longitudinal center plane of a four cylinder axial cam operated engine formed according to the invention, this particular embodiment being of novel three cycle variety. By suitable alteration of piston cam and valve cam profiles, this engine may operate as a two cycle or a four cycle engine also.

Referring first to FIG. 1, there is shown a four cylinder axial piston, axial power cam operated internal combustion engine of novel three cycle variety with variable combustion chamber volume and constant maximum charge density. Reference again is made to our co-pending Canadian application No. 378-226-3; filed 81-05-25; entitled—"Three Cycle Engine with Varying Combustion Chamber Volume" as stated in the "Background of the Invention", page 1.

In the novel three cycle process the charge is pre-compressed and is admitted into the combustion chamber, ready for immediate combustion, as soon as the charge admission valve has closed. High pressure charging takes place with the piston in the top position, in this version. The amount of charge admitted is determined by the volume of the combustion chamber during charge admission, and said volume is adjusted on-the-run to vary the power output as required. The cooled charge, at approximately 550 to 650 degrees Rankin, aids in reducing nitrous oxides, while at the same time, being constantly extremely dense, allowing deep expansion, greatly improving the thermal efficiency of the engine. The less charge is admitted in the novel three cycle process, the greater the thermal efficiency or expansion ratio, since the ratio between initial volume and final volume of the combustion chamber increases. As opposed to conventional engines, this engine therefore improves in efficiency as power is reduced. In addition, constant volume combustion may be achieved; the piston may be retained stationary till combustion is completed by virtue of the power cam profile, further improving efficiency. The improved thermal efficiency of this engine allows reduced air consumption; the charge pre-compressor may be considerably smaller in displacement than the displacement of the power cylinders. This fact, together with the potentially much better volumetric efficiency of the pre-compressor, as compared with a conventional power piston and cylinder, results in considerably less power consumption for the compression function. The pre-compressor, being double acting, may have one side continuously unloaded. During emergencies, when extra power is required, the second side of both stages may be activated simply by de-activating the unloading devices, the initial combustion chamber volume being increased to allow a doubling of the high density charge intake. The result will be a substantial boost in power, albeit at reduced efficiency. Additional advantages of the novel three cycle process are: potentially less oil consumption due to elimination of negative pressure in the combustion chamber. Ordinary engines have a fixed stroke length and a fixed aspiration capacity. The novel three cycle constant charge density process uses a separate charge pre-compressor allowing different aspiration capacities or geometric displacement for the pre-compressor and combustion sections of this engine. The basic concept behind the novel three cycle process with varying combustion chamber volume is to pre-condition the charge to optimum constant density and constant temperature and to deliver varying amounts of this pre-conditioned charge to a varying volume combustion chamber to vary power output.

The engine therefore may be divided into:

1. A charge pre-conditioning section, comprising of a charge pre-compressor, coolers, self-acting valves etc:
2. The engine's aspiration section, being the valve gear etc. for the combustion section:
3. The combustion section, devoted exclusively to combustion, expansion and exhaustion:
4. And for the power train section.

Ability to select pre-compressor capacity independently from combustion chamber capacity allows custom tailoring of the characteristics of the engine. For fuel efficiency the capacities would be chosen to achieve deep expansion in the neighbourhood of 20 to 1 or better, at full normal power output. Reducing power output will increase expansion ratios, improving efficiency. The preferred embodiments have two stage compression to 355 psia at 650 degree R giving a charge density equivalent to a 20:1 CR diesel, which would have a theoretical compression temperature of 1837 deg. R at 1004 psia compression pressure. An 8:1 CR ordinary gasoline engine would have a 1262 deg. R compression temperature.

Theoretical efficiencies based on an air cycle, would be

57% for the ordinary 8:1 CR gasoline engine

71% for the 20:1 CR diesel or 67% for a 15:1 CR diesel 67.5% for the three cycle engine version of this invention.

Peak temperatures would be:

5000 deg. R for the ordinary 8:1 CR engine 5575 deg. R for the 20:1 CR diesel or 5371 for the 15:1 CR diesel 4388 deg. R for the three cycle engine.

This would result in substantially lower nitrous oxides emission for the three cycle engine.

Exhaust temperatures would be:

2132 deg. R for the ordinary 8:1 CR engine 1632 deg. R for the 20:1 CR diesel or 1770 deg. R for a 15:1 CR diesel 1285 deg. R for the three cycle engine.

This would allow cooler exhaust valves and reduce muffling requirements substantially, both big bonuses.

At 50% charge intake, the theoretical thermal efficiency of the three cycle engine would be 76%.

It is believed that in actual practice, the improvements of the three cycle engine would hold true proportionally. Wasting 579 deg. F. in the inter and after-coolers of the three cycle engine has resulted in substantial improvements in fuel efficiency, nitrous oxides emissions and exhaust valve and muffling requirements, with substantially increasing efficiency at reduced power outputs. The two cycle and four cycle versions would gain benefits due to maximum compressed charge density at all, or nearly all power outputs.

Since the engines of this invention may be advantageously used as variable output expansion engines with any high pressure gas source, such as steam or Stirling type hot gas, or even plain compressed air, these expansion engines are included in the scope of this invention. By merely pressuring the charge admission ducting of the engines of this invention, these engines may be used with any high pressure gas source, with the power output determined by gas pressure and initial combustion chamber volume. Improvements of this invention practically eliminate power piston side thrust, promising less wear and friction. Additional advantages of the present embodiments will be better understood from the following descriptions.

In the drawings, numeral 1 generally indicates an axial piston axial cam operated spark ignition internal combustion engine having an annularly arranged, generally symmetrical cylinder block 2. The cylinder block includes four integrally cast cylinders 3 arranged in parallel, annularly and symmetrically around the long axis of the engine. The main shaft 4 is rotatably supported on the long axis of the engine by a large high capacity angular contact ball bearing 5 on the bottom end, and by a cylindrical roller bearing 6 at the top end; latter bearing rolls directly on the hardened and ground top end of the main shaft. Ball bearing 5 is mounted in the bottom casing 7, which also supports the thrust radius arms, to be disclosed shortly. Bottom casing 7 is precision spigotted coaxially to cylinder block 2. Similarly, cylinder head 8, is coaxially spigotted to the top end of cylinder block 2, while pre-compressor casings are further coaxially spigotted to the cylinder head and to one another. Integrally cast with main shaft 4 is axial power cam 9. Said cam 9 comprises an L-shaped annular ring, helically undulating to follow the axial profile designed for the engine, and "mounted" to main shaft 4 by way of an inwardly directed flange. Main roller 10, is conically tapered to minimize skewing and provided with a spherically radiused thrust surface, bearing against a matching surface formed on an outward vertical lip on the perimeter of axial power cam 9. FIG. 1 clearly indicates the intended apex and center for the surfaces of main roller 10. Reference is made to our co-pending U.S. patent application Ser. No. 229,315, filed 01-29-81, entitled "A Piston Connecting Yoke for Axial Piston Engines" for a description of conical tapered rollers for use with piston connecting means for axial piston axial cam engines. Main roller pin 11 is cantilevered radially inwardly from the end of tangentially oriented thrust radius arms 12, which are pivotably mounted on thrust radius arm pins 13, latter pin being supported in bottom casing 7, on a plane parallel to main roller pin 11; the axis of pin 13 is located halfway between the extreme top and bottom positions of main roller pin 11, so that the arc described by the centerline of pin 11 traverses the centerline of the cylinder twice during each up or downstroke. This is clearly shown in FIGS. 16 and 17. This results in a minimum arcing of piston link 14, thereby practically eliminating all piston side thrust; an advantage. Piston link 14 is bifurcated and straddles main roller 10 to center the loading. Just inward of piston link 14, the main roller pin 11 carries a small cam follower roller 15, which is trapped below an outward flange on the vertical leg of the L-shaped axial power cam 9. The cam profiles are designed to accommodate the slight arcing of the thrust radius arms 12; the profile also being designed to accelerate and decelerate the power pistons harmonically or parabolically. Novel thrust radius arms eliminate the usual thrust raceways or other torque thrust reaction means and take the great thrusts encountered with a minimum of friction and wear; they are a distinct and important improvement over conventional practice. Shims between roller 15 and link 14 eliminate "vertical" play for the assembled cam connecting means. Piston link 14 connects to power piston 16 by means of a conventional piston pin 17. Power pistons 16, not having to react strong side thrusts, may be made very light, an important advantage. Axial power cam 9 reciprocates power pistons 16, twice for every revolution. Pistons on opposite sides of the engine cancel out unbalanced forces, but set up a strong couple about the center of mass of the engine. However, the lopsided configuration of axial power cam 9 sets up a strong opposing couple, and therefore may be designed to cancel the piston couple, arriving at an inherently balanced engine, an important advantage. The two opposing piston pairs mutually cancel our inertia torque reactions also. While normally, axial piston layouts are provided with as many cylinders as possible, the object of this invention is utmost fuel efficiency and the displacement versus surface area situation therefore dictates as few cylinders as possible. The four cylinders of this embodiment provide four power impulses per shaft revolution, identical to an eight cylinder conventional engine; another advantage of the novel three cycle process. The external envelope size of this embodiment complete is 27" long×12" diameter for an equivalent displacement of 228 cubic inches, indicating the compact outline, an important benefit in today's smaller automobiles. Coaxial cylinder head 8 is provided conventional poppet type exhaust valves 18, axially oriented and located inwardly on the radial centerplane of each cylinder. Exhaust valve ports communicate with an annular torus shaped exhaust collector duct 19 cast integrally in the cylinder head. This is clearly shown in FIG. 4. Exhaust valves are conventionally spring biased and are actuated by hydraulic inverted bucket type cam followers 20, reciprocably disposed in bores provided in the casting for the cylinder head. Each cam follower 20 is provided with a cylindrical tower, spherically radiused at the top surface. The spherical radius on the top surface matches an annular, radiused groove, exhaust valve cam 21 located in the bottom outward edge of combined valve cam drum 22, a cylindrical drum, open at the top and coaxially carried in the cylinder head. Exhaust valve cam 21 comprises an annular, radiused groove, with an axially disposed profile to axially actuate cam follower 20. The spherically radiused tower on top of cam follower 20 is slightly off-set from the axial centerline of said cam follower. This allows cam follower 20 to rotate slightly in its bore, so that the spherical surface will seek the center of the radiused groove comprising exhaust valve cam 21. Alternatively, the cylindrical tower on top of cam follower 20 may hold a hardened steel ball in a spherical socket, again slightly off-set. This would allow rolling contact between exhaust valve cam 21 and said steel ball and would allow economical replacement. Alternatively, cam follower 20 may be equipped with a roller carried by the now bifurcated tower, said roller engaging exhaust valve cam 21.

Combined valve cam drum 22 is provided with a downwardly extending coaxial shaft 23, slidably engaging the top end of main shaft 4 by way of matching splines. A couple of opposing annular contact high capacity ball bearings 24, radially and axially support combined valve cam drum 22, while spigotted engagement with the main shaft 4, ensures accurate coaxial alignment. Bearing retaining plate 25 is secured to the cylinder head casting by means of a number of countersunk machine screws. Bearing retaining nut 26 locks ball bearings 24 to shaft 23.

Outward from the exhaust valves, on the same radial plane, a small bore is provided in the cylinder head casting, said small bore being approximately one-half the diameter of the cylinders 3. Said small bore, reciprocating cylinder head bore 27, is continuous, straight through the cylinder head. A wide, vertical slot, guide slot 28, located on the radial centerplane of each cylinder is machined in the casting of the cylinder head and establishes communication between the cylindrical coaxial cavity for the combined valve cam drum 22 and bore 27.

Mini reciprocating cylinder head 29 comprises a double walled light alloy cylinder, reciprocally disposed in bore 27 and extending beyond the top end of said bore 27 a small distance, to terminate inside upper travel limiter 39. Said head 29 is provided with conventional piston rings on the bottem end to seal in combustion pressures. Coaxially disposed within the inner bore of head 29 and carried by same, is charge admission valve 30. Said valve 30 comprises a conically shaped head portion, seatable against an annular valve seat provided on the inside bottom edge of said head 29, to close communication between the combustion chamber and the charge admission port, an annular space formed directly above said conically shaped head portion. Valve 30 further comprises an integral spool, reciprocably disposed in said inner bore of head 29 and carrying sealing means in the form of miniature piston rings of self lubricating material. Said spool is connected to said conical head portion by way of a pinched waist portion. Extending upwardly from said spool is a coaxial stem, provided with a groove for a conical valve keeper. A spool type spring retainer retains valve bias spring 31 and is reciprocally disposed in the inner bore of head 29, accurately centering and guiding the end of the valve stem. A heavy duty snap ring and an annular spring seat 32 provide a reaction seat for valve bias spring 31. Charge pressure within said charge admission port will neutrally bias charge admission valve 30 due to equally exposed areas. Positive upward biasing by charge pressure may be achieved by enlarging the spool diameter relative to the inside diameter of the charge admission valve seat. Reference may be made to our co-pending Canadian application no. 378-226-3; filed 81-05-25; entitled "Three Cycle Engine With Varying Combustion Chamber Volume" for a further description of above novel charge admission valve. A small hardened cap 33 provides an engaging surface. Carried by said head 29 at an acute 45 degree upward angle is charge admission valve actuator 34, being reciprocally disposed in a low friction bushing. Said bushing is installed in a swelled, outwardly extending boss, protruding from the outside cylindrical surface of head 29. Said outwardly extending boss is slidably engaging guide slot 28, thereby preventing rotation of head 29. Actuator 34 may preferably be rectangular or square in cross section, although a cylindrical shape is shown. The top end of actuator 34 is provided with a vertical cylindrically shaped engaging surface, said surface being parallel to the axis of head 29, and engaging the outside cylindrical surface of combined valve cam drum 22. Said cylindrical valve cam surface is provided with a radially disposed actuating lobe for actuating said charge admission cam follower, said lobe equalling in width the height of said cylindrical valve cam surface. The result is that the charge admission valve will remain in positively timed relationship with the power piston regardless of the vertical position of said head 29, within the limits of the reciprocating travel of said head 29. A bifurcated end on actuator 34 carries a small roller to engage the hardened cap 33. The simple novel actuating mechanism for charge admission valve 30, as disclosed, represents one of the objects of the present invention, namely to provide a simple valve actuation means which maintains accurate valve timing regardless of the relative position of head 29. A sealed plug, 35 seals off the valve bias spring space. Head 29 is provided with a number of bypass ports 36 in the thick cylindrical wall, said ports 36 terminating downward in slotted openings, communicating with the charge admission valve port and terminating upward in slotted openings communicating with the interior bore of head 29, above plug 35. The upper interior bore of head 29 is provided with a thin walled ferrous cylindrical insert to provide wear resistance as a sealing surface for seal rings carried by a static charge admission snorkel tube 37, which communicates with the discharge from the aftercooler to be disclosed later.

The outside cylindrical surface of head 29 is provided with an integral, or added on, annular cylindrical ledge, travel limit ledge 38. The reciprocating cylinder head bore 27, terminates in an enlarged counterbore in the top end of cylinder head 8. This enlarged counterbore rotatably accommodates upper travel limiter sleeve 39, an internally threaded cylindrical sleeve, with an annular external ledge, the bottom outside corner of which is provided with worm gear teeth, and on top of which ledge annular thrust ball bearing 40 is seated. Threadably engaging the inside of sleeve 39 is upper travel limiter ring 41, which is reciprocally disposed coaxially around the upper portion of head 29, above ledge 38. Ring 41 is prevented from rotation by a key and keyway. Sleeve 39 is actuated to rotate in either direction by travel limiter drive shaft 42, a worm teeth equipped shaft, rotatably carried by cylinder head 8 and prevented from axial fore and aft displacement by small thrust bearings, not shown. Statically installed in the bottom of the counterbore in cylinder head 8, coaxially around head 29, and below ledge 38, is a hardened steel, precision ground, thick flat ring, seating ring 43. Rotation of shaft 42 in either direction will raise or lower ring 41, thereby adjusting the upward travel limit of head 29, with ledge 38 being driven against ring 41 by combustion chamber pressure, upon opening of charge admission valve 30. Adjustment of the upper travel limiter therefore effectively adjusts the initial volume of the combustion chamber. Said initial volume determines the charge weight admitted with the charge being at constant extremely high density, but relatively cool in temperature. The charge weight determines the power output. Therefore power output is adjusted by adjusting the combustion chamber volume. The small diameter of bore 27 allows a less sensitive adjustment range. Power piston 16 is held stationary during the charging process, and is located with extremely small clearance between the crown of the piston and the roof of the combustion chamber formed by cylinder head 8. Virtually the complete charge will be contained within bore 27. A curved cavity in the crown of the piston extending below the bottom edge of bore 27 accommodates the tip of the spark plug. See FIG. 4. As soon as valve 30 is closed ignition is commenced and combustion takes place under constant volume, with no piston movement as yet, or slight movement if desired. The actual combustion chamber therefore is formed within bore 27, and this chamber will have a very favourable diameter to height ratio since the entire charge is packed in a small diameter bore. Cylinders 3 therefore act as gas expansion cylinders. As soon as power piston 16 has reached the bottom position exhaust valve 18 is opened, the pressure drops to atmospheric and mini reciprocating cylinder head 29 moves downward due to the strong bias exerted by the charge in snorkel tube 37. In this down position, the final combustion chamber volume is practically zero and very efficient expulsion of exhaust gasses takes place. The ascending and descending movement of head 29 is cushioned by a continuous supply of engine lube oil to the spaces above and below ledge 38. Hence the importance of seating ring 43, it traps oil above it. The degree of hydraulic cushioning is determined by orifices. Full density of the charge is not required for start-up, although a small reserve tank may be employed.

Figures 5, 6, 7, 8, 9, 10:
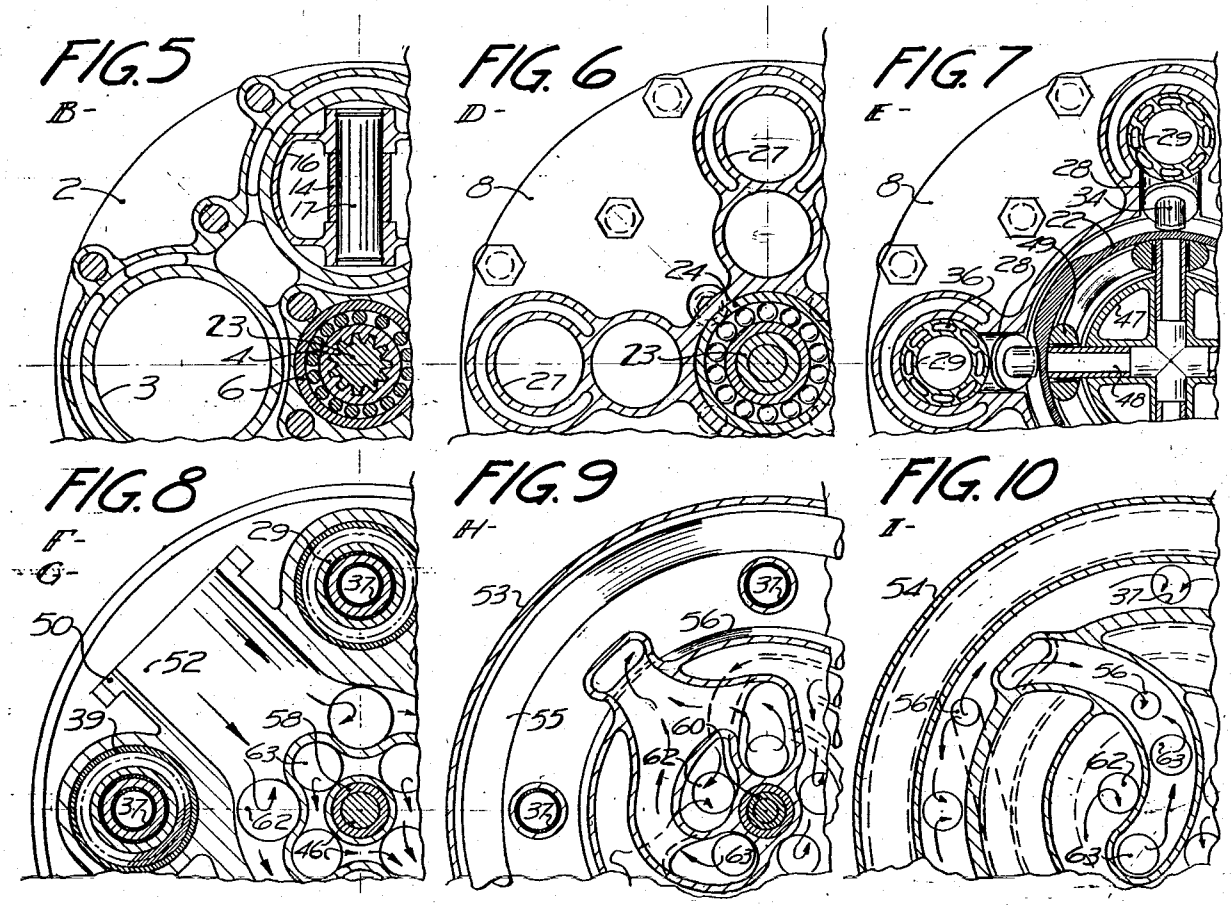
FIG. 5 is a partial cross section taken on plane B in FIG. 1 and shows the large cylinder bores, annularly and symmetrically arranged around the long axis of the engine, the upper main shaft bearing, and a cross section through a piston. The piston, not having to take side thrust reactions, is executed lighter than usual.
FIG. 6 is a partial cross section taken on plane D in FIG. 1 and shows the bores for the novel mini reciprocating cylinder head, the bores for the hydraulic cam followers for the poppet type exhaust valves, and one of the angular contact ball bearings for the novel combined valve cam and charge pre-compressor reciprocator.
FIG. 7 is a partial cross section taken on plane E in FIG. 1 and shows the bores of the novel mini reciprocating cylinder head, and the novel combined valve cam and charge pre-compressor reciprocator.
FIG. 8 is a partial cross section taken on planes F and G in FIG. 1 and shows the channels cast in the flat pan-cake style cylinder heads for the pre-compressor first stage and the cartridge type self-acting air inlet and air discharge valves. Also shown are the coaxial upper travel limiters for the mini reciprocating cylinder heads.
FIG. 9 is a partial cross section taken on plane H in FIG. 1 and shows the channels cast in the flat pan-cake style cylinder heads for the pre-compressor second stage with snorkel charge admission tubes also shown. Also shown is the intercooler coil within the coolant jacket of the pre-compressor.
FIG. 10 is a partial cross section taken on plane I in FIG. 1, and shows the channels cast in the flat pan-cake style cylinder head for the pre-compressor second stage; shown is the inlet to the after cooler coils and the outlet from same discharging into a coaxial torus shaped duct, distributing the cooled, pre-compressed extremely high density charge to the snorkel tubes which feed the miniature reciprocating cylinder heads; fuel injection into the inlet openings of the snorkel tubes is preferred at this point; with the fuel being injected off-center, stratified charging of the miniature combustion chamber may be achieved, with the rich mixture being transmitted virtually undiluted to the vicinity of the spark plug tip by way of the by-pass ports in the miniature reciprocating cylinder head.

Turning now to a description of the charge pre-compressor. Combined valve cam drum 22 is provided with an integral internal, axially directed annular raceway, on the bottom inside edge, and with a matching but opposing cylindrical raceway, upper raceway 44, which closely fits inside drum 22, and is retained by a precision ground, transversely split annular ring, retaining ring 45, which fits closely in a groove in the inside surface of drum 22. Threaded fasteners secure the assembly as shown. Said opposing raceways are axially profiled to form four crests and four valleys symmetrically spaced. Pre-compressor piston rod 46 comprises an integrated coaxial assembly of a bottom guide rod, coaxially and reciprocably disposed in a coaxial bore in drum 22, and a cylindrically shaped reciprocator drum 47. Said drum 47 is cross bored to carry four cantilevered reciprocator shafts 48, radially and symmetrically disposed, and rotatably carrying on eliptically shaped roller, reciprocator roller 49, on each end. Said roller 49 is trapped between the opposing profiles of the reciprocator raceways. The inside diameter of reciprocator drum 47 is provided with internal splines, axially disposed, matching and engaging external splines provided on a coaxial cylindrical extension of the first stage compressor cylinder 50. Rotation of combined valve cam drum 22 will reciprocate the reciprocator drum 47 over four strokes for every revolution. Efficient air compressor design calls for a large bore short stroke layout wth a minimum of clearance space or "dead volume". The arrangement allows excellent aspiration capacity and low piston speeds. This design requirement is taken advantage of to reduce engine length, provide room for a good number of cartridge type sefl-acting valves in the heads, and to provide one compressor stroke for each cylinder stroke per revolution, synchronizing pressure pulsations with charge admission. First stage compressor cylinder 50 is an integrated casting and includes the first stage lower cylinder head 51 and four downward directed bores at the perimeter to spigot coaxially over the protruding top ends of upper travel limiter sleeves 39 and to trap thrust ball bearings 40. Referring briefly to FIG. 8, will reveal the flow of air in and out of the bottom side of the first stage compressor. Air inlet duct 52 communicates with the air inlet channel for both sides of the first stage compressor. The air discharge channels for both sides of the first stage compressor combine and are funneled upward by way of a channel provided in the second stage compressor cylinder casting 53. Said channel terminates against a matching channel cast in the second stage upper cylinder head 54, from where the first stage discharge air is directed into the inlet end of the intercooler coil 55. Said coil 55 is coaxially disposed within the integrated coolant jacket of second stage compressor cylinder casting 53 and has the inlet and outlet end permanently swaged or otherwise installed in the bottom face of second stage upper cylinder head 54. Casting 53 is provided with annular coaxial openings in the top surface to allow the lowering into, and the raising out of, the coolant jackets of both intercooler coil 55 and aftercooler coil 56. Both ends of said aftercooler coil 56 are also permanently installed in the bottom face of second stage upper cylinder head 54. The integrated pre-compressor and cooling coil assembly as disclosed and illustrated makes for a neat package free from exterior plumbing, greatly facilitating manufacture and maintenance and enhancing dependable operation. The first stage compressor upper head and the second stage lower head are integrated into the second stage compressor cylinder casting, as are the coolant jackets for the coolers. The discharge from intercooler coil 55 is channeled to the inlet valves for both sides of the second stage compressor. The discharge from both sides of the second stage compressor is channeled to the inlet of the aftercooler coil 56 while the outlet of the aftercooler coil 56 terminates in a torus shaped coaxially disposed duct cast in second stage upper cylinder head 54. FIG. 10 clearly illustrates this arrangement. Said torus shaped duct acts as an air receiver dampening pulsations. Four electronically controlled fuel injectors conveniently located in the second stage upper cylinder head 54 inject fuel into the top ends of charge admission snorkel tubes 37. By directing the fuel injection off center, a stratified charge admission may be effected; bypass ports 36 will transmit the richer portion of the charge to the vicinity of the spark plug tip. This invention therefore allows stratified charging without additional valving etc.

First stage lower cylinder head 51 is provided with piston rod guide bushing 57, threadably spigotted for exact concentricity, said bushing 57 also serves to retain piston rod seals 58. First stage piston 59 is coaxially mounted on pre-compressor piston rod 46 and retained to operate on the two cycle principle or the four cycle principle and as such these operating modes are included in the scope of this invention.

Profile 64 is a symmetrical three cycle profile. Power piston 16 is retained in the top position while high pressure charge admission is carried out over 60 degrees of mainshaft rotation; the top position is subsequently maintained over an additional 30 degrees of mainshaft rotation while constant volume combustion is accomplished, after which uniform acceleration and deceleration carries said power piston 16 down to the bottom position. In the bottom position the piston is stationary over 90 degrees of mainshaft rotation allowing exhaust gas evacuation; subsequently the piston is returned to the top position expelling all exhaust gas remnants. The symmetrical profile results in symmetrical movements for power pistons on opposite sides of the engine, enhancing free force balancing.

Profile 65 is an asymmetrical three cycle profile. Again power piston 16 is retained in the top position over a total of 90 degrees of main shaft rotation to accomplish high pressure charging and subsequent constant volume combustion. The power piston is carried down, but is not retained in the bottom position, or is retained only very briefly, and is subsequently carried up to the top position while positive expulsion of exhaust gasses takes place by the upward movement of said piston.

Profile 66 is a symmetrical two cycle profile; the power piston retained in the top position over 30 degrees of main shaft rotation while constant volume combustion takes place, the expansion stroke subsequently carrying the power piston down to the bottom position, the exhaust valve opening before the bottom position is reached, a low pressure pressurized charge being admitted by opening the charge admission valve, scavenging being carried out therefore while the power piston is retained in the bottom position over 30 degrees of main shaft rotation, the subsequent compression stroke carrying the power piston to the top position. Profile 66 may be executed to eliminate either or both top and bottom retention of the power piston.

Figures 17, 18:
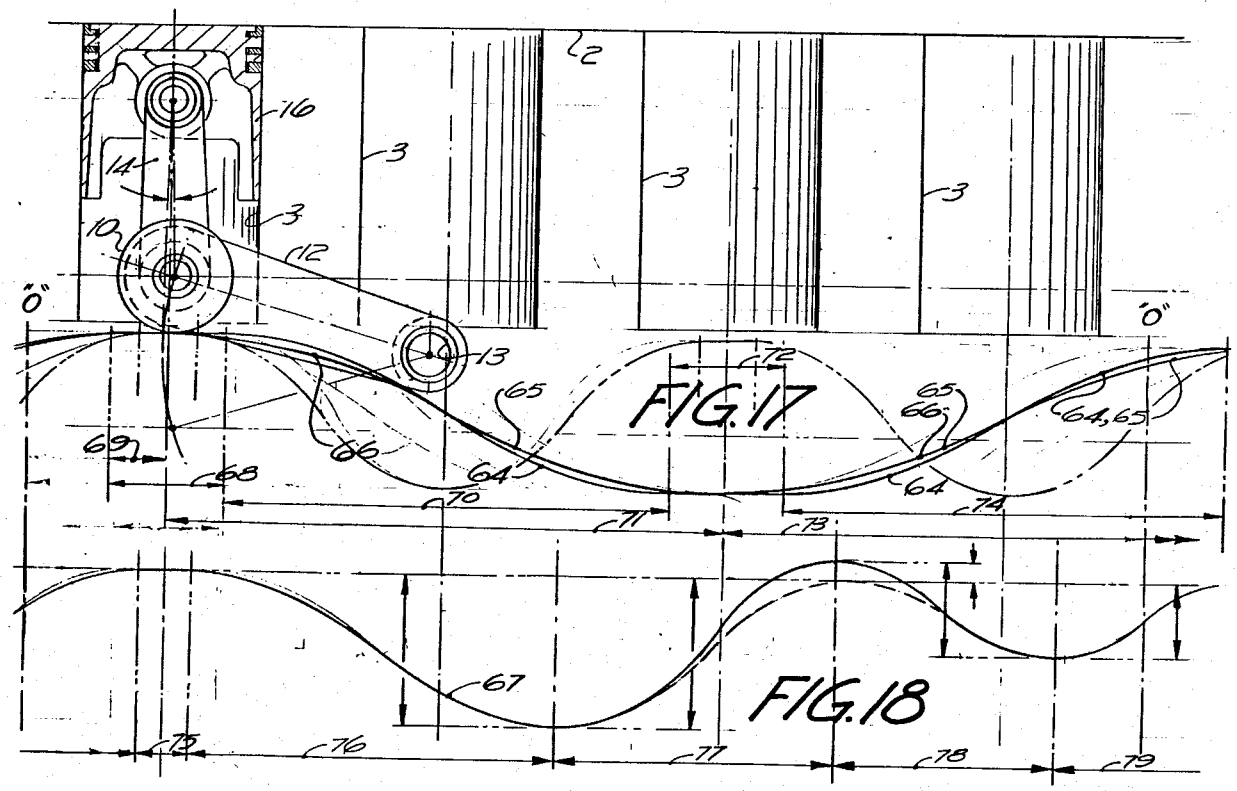
FIG. 17 is a schematic view on a flat plane of the profiles of the axial power cam of the engine shown in FIG. 1. Profiles shown apply to two cycle and novel three cycle versions, having two piston strokes per revolution.
FIG. 18 is a schematic view on a flat plane of the profile of the axial power cam of the engine shown in FIG. 1 executed to operate on the four cycle process. The shallow intake stroke may be naturally aspirated or boosted by a piston type or rotary turbo super-charger. The profile gives four piston strokes per revolution.

Profile 67 in FIG. 18 is an asymmetrical four cycle profile. Power piston 16 is retained in the top position over 15 degrees of main shaft rotation to achieve constant volume combustion. Note: Since the pistons complete four strokes for every revolution of the main shaft, in the four cycle mode of operation, 15 degrees of main shaft rotation is equivalent (in piston retention time) to 30 degrees of crankshaft rotation for an equivalent crank shaft driven four cycle engine. The subsequent expansion stroke carries the piston to the bottom position. The subsequent exhaust stroke carries the piston to one of two alternative positions. The "total exhaust expulsion" position will carry the piston to an extremely high position, barely clearing the roof of the combustion chamber, with a depression in the crown of the piston accommodating the still slightly open exhaust valve. This clearly shown in FIG. 18. This extremely high position also has the advantage of an extremely efficient fresh charge induction stroke, following well known gas laws, since the combustion chamber starts with practically zero volume. The alternative top position at the end of the exhaust stroke is equivalent to the compression top position. Subsequently the piston is carried to an intermediate position. For fuel efficiency this "intermediate" position will be approximately half way down. The greatly reduced charge intake will subsequently be compressed to maximum permissible value. With the expansion stroke twice the length of the induction stroke, deep expansion will result, giving greatly improved thermal efficiency. Normally, this procedure requires a much larger displacement. However, the substantial improvement in thermal efficiency due to deep expansion, allows this version of the invention to be executed with only a moderate increase in displacement, as compared to a normal equivalent four cycle engine.

In FIG. 17, 68 represents the constant volume three cycle charging and combustion main shaft rotation angle. Note: Conventional four cycle automotive engines at 4000 rpm, (2000 power strokes per minutes) require 30 degree ignition advance maximum. This equals 0.042% rotational angle. (720 degrees divided by 30 degrees). Constant volume charge adds 0.063%, for a total of 0.105% rotational angle. This is indicated as 68 in FIG. 17. For a double lobed cam this distance is reduced by one-half. 69 is the constant volume combustion main shaft rotation angle for the two cycle mode; 70, 71 is the expansion mainshaft rotation angle; 72 is the three cycle constant volume exhaust evacuation or two cycle constant volume scavenging mainshaft rotation angle; 73, 74 is the three cycle positive exhaust expulsion or the two cycle charge compression mode mainshaft rotation angles.

In FIG. 18, numeral 75 indicates constant volume combustion, 76 represents the expansion cylce, 77 represents the exhaust cycle, 78 represents the induction cycle, 79 represents the compression cycle. It should be understood that for the novel three cycle mode or two cycle mode of operation, the axial power cam may also be profiled to execute four strokes per revolution. Following simple mechanical laws, a greater number of strokes means a steeper cam profile resulting in greater side thrust. For the novel three cycle or two cycle mode of operation 2000 power impulses per minute with a "single lobe" axial power cam requires 2000 rpm. The four cycle version requires 4000 piston strokes and 2000 rpm to give 2000 power iimpulses per minute. Therefore the piston speeds for the four cycle versions are considerably greater. The piston travel of the charge pre-compressors for the novel three cycle version, or the piston travel for the charge scavenging low pressure compressors for the two cycle version is considerably less than the extra piston travel required by the four cycle version because the charge pre-compressors or charge scavenging compressors allow large bore, extremely short stroke layouts.

Providing a double "lobed" axial power cam for the novel three cycle version or two cycle version, reduces the revolutions to 1000 rpm for the identical 2000 power impulses per minute. As stated before, the steeper profile in this case would result in a doubling of side thrust, or torque reaction thrust, and, of course, a doubling in torque output. The profile for a "double lobed" axial power cam is shown in FIG. 17 in chain dotted outline. The novel thrust radius arms of this invention easily can accommodate the doubling of torque reacting side thrust; they therefore allow less torque multiplication to take place in the final drive of the vehicle since the engine itself acts as a torque multiplier. Compared with a crankshaft driven normal four cycle engine, this invention may have an output speed of 1000 rpm, versus 4000 rpm for the normal four cycle engine, both at 2000 power impulses per minute. Since vehicles often have an approximately 4 to 1 reduction in by spacer sleeve 60. Additional piston rod seals are installed in the second stage compressor cylinder casting 53 to seal and separate the stages; FIG. 9 shows these seals. Second stage piston 61 is retained on the top end of said piston rod 46 by means of a flush threaded fastener. Self acting inlet valve cartridges are shown as numeral 62, while self acting discharge valve cartridges are 63. The bottom side of the first stage compressor may be continuously unloaded by means of solenoids and small rods acting on the self acting inlet valves, said rods entering the first stage bottom cylinder head laterally and mounted between the upper travel limiter housings. Similarly the top side of the second stage compressor may be continuously unloaded. For normal operation, in the economy mode, the top side of the first stage and the bottom side of the second stage, would be operative with the output approximately equal to one-half the normal aspiration capacity of the power cylinders. This would result in deep expansion, or twice the expansion ratio of an equivalent four cycle engine. However, since the charge is far denser, due to two stage compression and cooling, the initial combustion chamber volume would be that much smaller again, resulting in a further increase in the expansion ratio. The cooled charge results in low nitrous oxides emissions while the great expansion ratio results in high thermal efficiency, further aided by constant volume combustion, stratified charging if desired, and good combustion chamber shape. Since the cylinders fire on every downstroke, the number of power impulses of this very compact embodiment of the invention equals that of an eight cylinder normal engine. Cooling the charge achieves high density without the great mechanical force required by an equivalent four cycle engine to achieve equivalent density. By activating the unloaded sides of the pre-compressor and by a simultaneous increase in the initial combustion chamber volume to accommodate the doubled output, a great boost in power may be achieved, for emergency situations albeit at lower fuel efficiency. The starting torque required for this engine is low, since the engine will fire with low pressures prevailing—the action is similar to the compression relief system used on normal engines. The deep expansion results in low exhaust noise; muffling requirements will be reduced considerably. Reduced power outputs in this embodiment will result in even greater expansion ratios; with the charge maintained at constant high density, the thermal efficiency will increase. Diesel versions would not take in more air than required for combustion, resulting in much greater expansion ratios than in normal diesels, at reduced power outputs, thereby improving efficiency; glow plug ignition aid would be required. This invention has lower pumping losses, working against a lower vacuum. The pre-compressor output may be regulated by intake valve unloading or air intake throttling; since the activated pre-compressor capacity is one-half the normal aspiration capacity of the power cylinders, far less pumping losses will be encountered. Since the cylinders fire in sequence, a smooth power flow will result with four firing strokes per revolution. With no negative pressures encountered in the combustion chambers, oil consumption will be less, and will stay lower as the engine wears. The engine will not require new untried technologies, with every component fully predictable in performance.

The ideal requirements for free force balance are a downward acceleration for the power piston on one side of the engine counterbalanced by an equal upward acceleration on the other side; together setting up a couple, and having this couple counterbalanced by an opposing couple set up by the great dynamic unbalance of the axial power cam. This situation, ideal from a free force balance viewpoint, sets up inertia torque reactions (instantaneous torque on the power camshaft due to inertia of accelerated or decelerated masses) with pistons 1 and 3, on opposing sides of the engine, being accelerated in step. Referring to FIG. 17, it may be noted that simultaneously, pistons 2 and 4 are being decelerated at the identical rate at which pistons 1 and 3 are being accelerated. The decelerating torque reaction is equal and opposed to the accelerating torque reaction; therefore, the single lobed version of FIG. 1 with four power cylinders, appears virtually ideal from a free force balance and inertia torque reaction view point, which means that the weight of the reciprocating mass is not quite as critical, allowing sturdy substantial main roller construction; the power pistons not being subjected to side thrust allow extremely light construction, thus saving more weight for the main rollers. While the prior art of axial piston engines is not endowed with many examples of successful piston-to-cam connecting means, it is believed that the present invention makes possible an extremely rugged power cam and rugged main roller, yet light but stiff, piston connection and torque reaction means in the form of a bifurcated piston link and a bifurcated, or cantilevered, but particularly bifurcated, thrust radius arm assembly. In addition, the spherically radiused rollers allow for manufacturing tolerances, load and thermal deflections, maintaining good line contact. Straight line contact rollers would require slightly stiffer construction.

Figures 2, 3, 4:
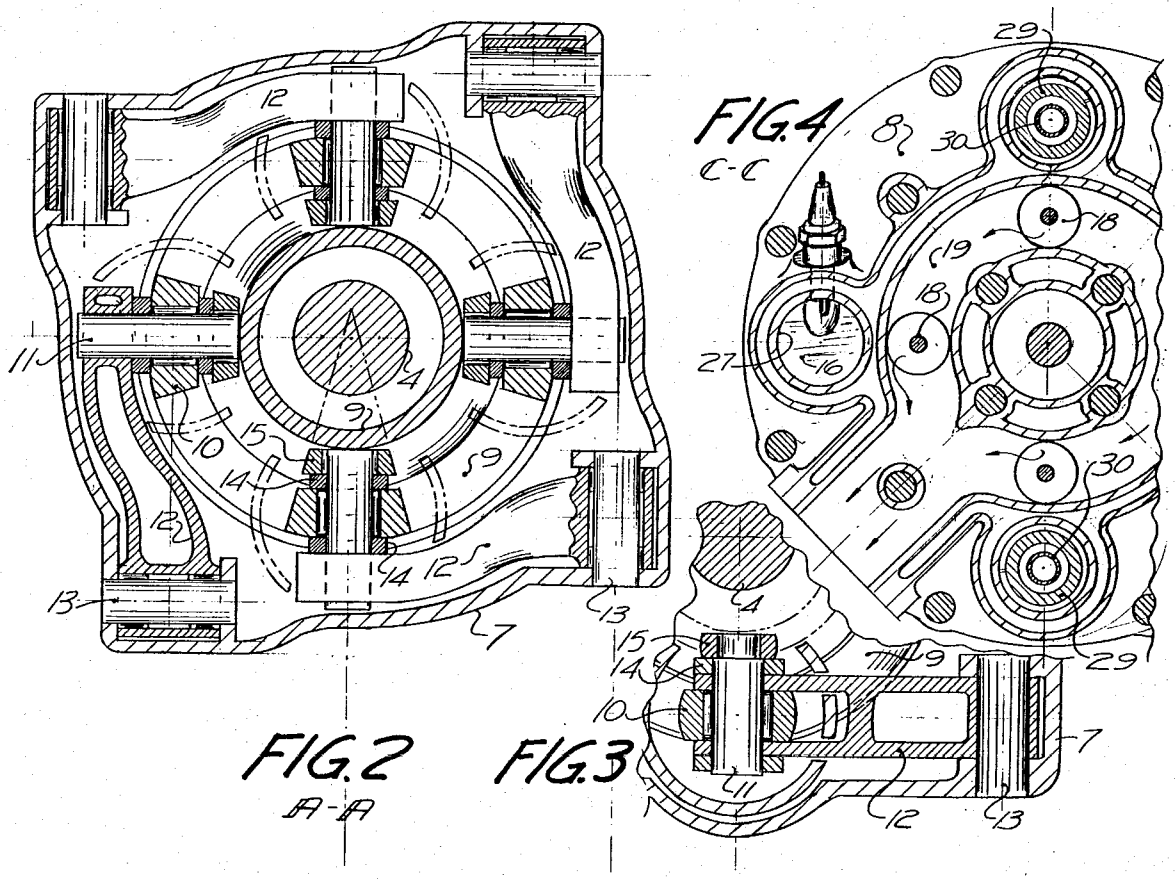
FIG. 2 is a cross section taken on plane A—A in FIG. 1 and shows the plan view of the axial cam, novel cam rollers and novel cantilevered thrust radius arms.
FIG. 3 is identical to FIG. 2, except being partial in extent, showing a novel alternative bifurcated thrust radius arm.
FIG. 4 is a partial cross section taken on plane C—C in FIG. 1, and shows the annular torus shaped exhaust collector duct, the cylinder head bolts, the miniature bores for the novel miniature reciprocating cylinder head, and the ignitor location, operating in a curved cavity provided in the top of the piston and reaching beyond the lower edge of the miniature bore for the said head.
Figures 11, 12, 13, 14, 15, 16:
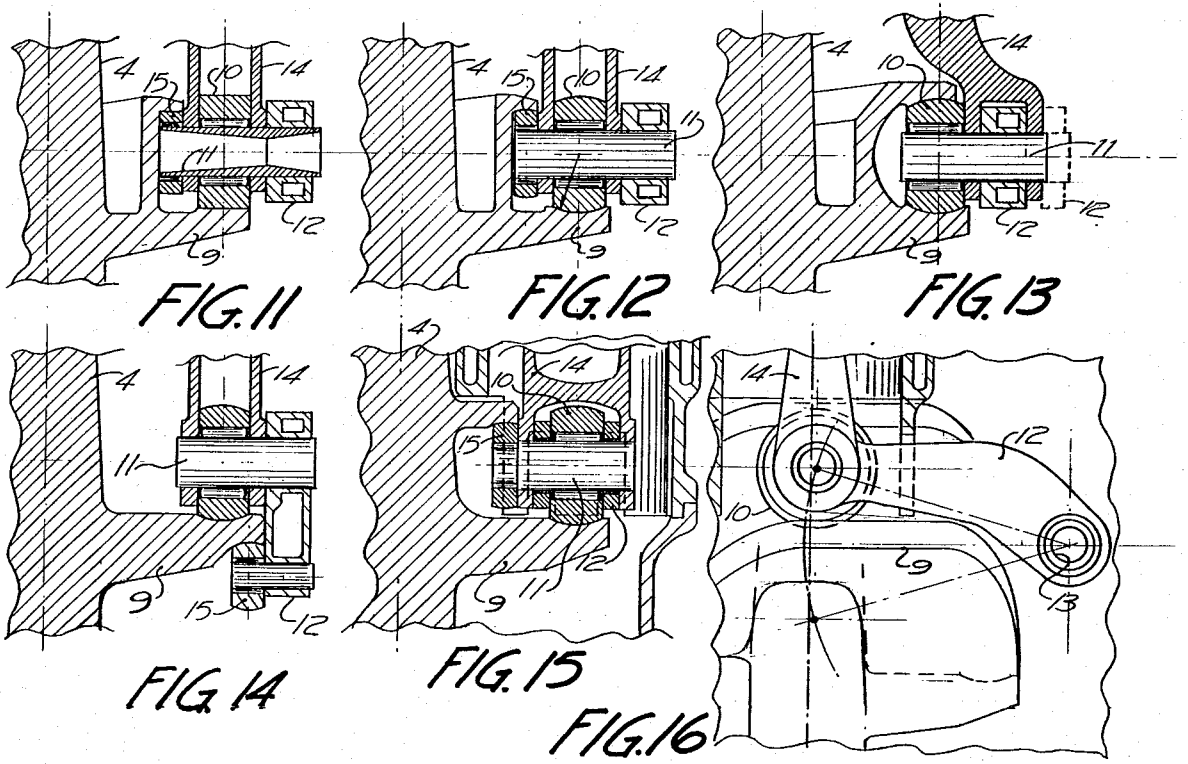
FIG. 11 is a partial transverse cross section on the longitudinal centerplane of the engine shown in FIG. 1, showing alternative cylindrical axial cam rollers.
FIG. 12 is the same as FIG. 11, except the axial cam rollers are spherical for better line contact under deflected conditions caused by heavy loading.
FIG. 13 is the same as FIG. 11, except the small inward cam follower roller is eliminated, the main roller being trapped between two axial profiles, with an off-set bifurcated piston connecting link straddling the cantilevered thrust radius arm.
FIG. 14 is the same as FIG. 11, except the small inward cam follower roller is replaced by a bottom carried cam follower roller, carried on a small downward extension on the cantilevered thrust radius arm end.
FIG. 15 is the same as FIG. 11, except the rollers are spherical and the cantilevered thrust radius arm is replaced by a bifurcated thrust radius arm, with the bifurcated piston connecting link straddling the ends of said radius arm.
FIG. 16 is a side view of the components shown in FIG. 15, showing the dog leg shaped bifurcated thrust radius arm. A plan view of this arrangement is shown in FIG. 3.

FIG. 2 is a cross section taken on plane A—A in FIG. 1 and clearly shows the compact arrangement of the cantilever thrust radius arms 12, with the line of force passing through the middle of thrust radius arm pin 13. Clearly shown are the bottom extension skirts of the cylinder walls, said skirts clearing all working components, and required to stabalize the power pistons 16 while in the bottom position. Lighter thrust radius arms may be provided by the bifurcated design shown in FIG. 3. FIGS. 15 and 16 further illustrate this embodiment. Spherical rollers will eliminate the thrust collar required on the axial power cam, but will result in skewing line contact. However, their big advantage will be maintenance of line contact despite load deflections. By allowing slight lateral floating action, the rollers will center in the profile groove. FIGS. 11, 12, 13, 14, show alternative roller configurations and are self-explanatory.

FIGS. 4, 5, 6, 7, 8, 9 and 10 show various cross sections of the engine shown in FIG. 1 and are self-explanatory, after having consulted the disclosure description for FIG. 1. Note that FIG. 6 does not show moving parts, for clarity.

FIGS. 11, 12, 13, and 14 show alternative embodiments for main roller 10, cam follower roller 15. Spherical rollers have the important benefit of maintaining line contact under deflected conditions due to heavy loading.

FIGS. 15 and 16 show an alternative embodiment for thrust radius arm 12, being bifurcated, and dog-leg shaped to clear the rim of axial power cam 9. Bifurcated construction of said arm 12 allows lighter weight.

FIGS. 17 and 18 are schematic views showing alternative cam profiles. By suitable alteration of cam profiles, all embodiments of this invention may be executed the final drive, this invention, allows this 4 to 1 reduction to be eliminated and the main shaft may drive the wheels directly in "top gear". "Intermediate gear". Intermediate gears would be less in number since the engine torque is four times as great. Instead of five or six intermediate gear steps, two or three would suffice.

Figures 19, 20, 21:
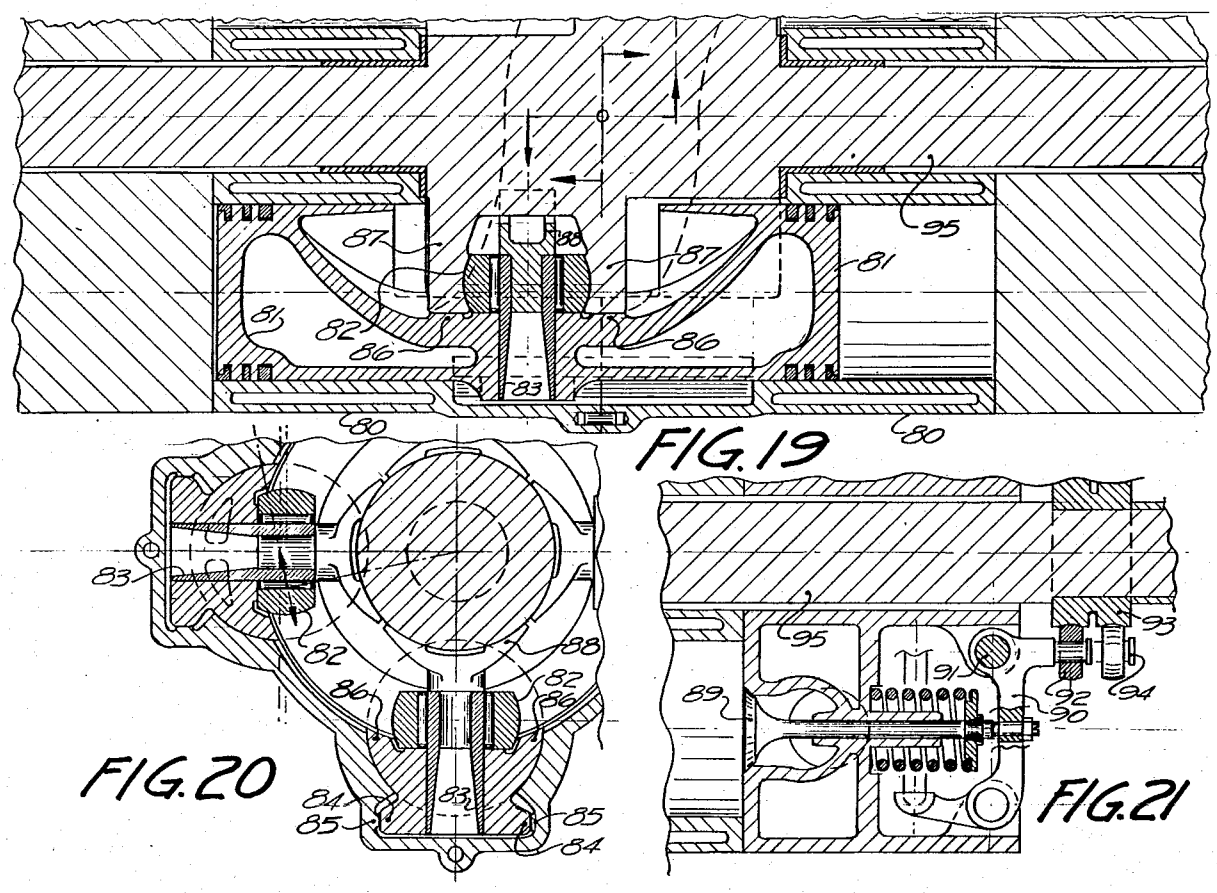
FIG. 19 is a cross section of an axial piston engine taken on the longitudinal centerplane similar to the engine shown in FIG. 1, except with monolithic double acting pistons carrying one mutual cam roller trapped between opposing axial profiles on the axial power cam.
FIG. 20 is a cross section taken transversely across the axial power cam shown in FIG. 19, and neglects the rise and fall of the profile; shown is the critical midsection of the monolithic pistons.
FIG. 21 is a cross section taken on the longitudinal centerplane of an axial piston engine, such as shown in FIGS. 1 and 19, showing an alternative cylinder head employing conventional poppet valves.

FIG. 19 shows a cross section taken on the longitudinal centerplane of an engine as shown in FIG. 1, except executed double acting using monolithic power pistons. Symmetrical, identical cylinder blocks 80 are placed bottom to bottom to form an outwardly opposed piston engine assembly; precision dowel pins ensure precision alignment of cylinders. During manufacture both cylinder blocks are assembled bottom to bottom and finish bored and honed simultaneously ensuring precision alignment of bores. One piece monolithic pistons 81 are double acting, having combustion chambers on both ends, and carry a single cam roller 82 on a cantilevered roller pin 83. An outwardly extending boss on pistons 81 provides extra support for cantilevered roller pins 83; said boss is provided with laterally extending wings, piston anti-rotation pads 84, These pads reciprocally engage and are trapped between, axialy disposed slideways 85, machined integrally in cylinder blocks 80. Cam roller 82 is located slightly inward of the long axis of pistons 81; the thrust reaction line will pass through the said long axis, minimizing rotating forces on pistons 81. This is clearly shown in FIG. 20. An additional, or alternative anti-rotation means for pistons 81, are cylindrically machined pads on the waist section of the pistons, anti-rotation pads 86, bearing directly against the cylindrical outside surface of axial power cam 87, just beyond the front and back faces of cam roller 82. Axial power cam 87 comprises a helically winding or coiling thick radial flange, with an axially profiled groove in the outside cylindrical surface, said groove has two matching and opposing spherically radiused raceways to closely accommodate spherically radiused cam roller 82. Said groove is deep enough to allow the installation of cam roller 82 by holding it sideways, or "on the flat". The bottom of said groove may be machined to form an accurate cylindrical surface. This cylindrical surface may be used as a reaction surface for an additional alternative anti-rotation means for pistons 81, anti rotation yoke 88, provided the axial profile of axial power cam 87 is not too steep. Yoke 88 is provided with a cantilevered shaft-like extension which enters and is supported by, the inside diameter of roller pin 83. The strong couple force set up by the dynamically unbalanced axial power cam will counterbalance the couple force set up by the pistons, on opposed sides of the engine, for a single lobed cam.

The embodiment shown in FIGS. 19 and 20 may be equipped with the cylinder head, valving and pre-compressors shown in FIG. 1 to be executed as a two cycle, the novel three cycle, or four cycle engine. As a four cycle engine, the charge may be pre-compressed and cooled exactly the same as required for the novel three cycle concept; the dense cool charge would be injected into the combustion chamber, which, due to its large size and downward movement of the power piston, would expand the pre-compressed cooled charge. This expansion would super cool the inducted charge. The subsequent compression stroke would re-compress the charge and the temperature of the charge would rise to a certain value which would be much lower than the temperature of a normally compressed charge. The result would be a dense charge at much lower temperature than normally encountered. The process described must not be confused with normal supercharging. In normal supercharging, the inducted charge may be cooled, but is at low pressure, a maximum of 30 psig, and is not expanded while inducted. The purpose of a short, high pressure induction, followed by a short expansion, and a subsequent re-compression would be to gain the benefits of the novel three cycle process for a modified four cycle mode of operation, the benefits being low nitrous oxides formation and a high expansion ratio, results of a cool high density charge. This modified four cycle process is therefore included in the scope of this invention. The said modified four cycle process may especialy be readily carried out with cam driven engines since a short induction and re-compression stroke may readily be introduced between the long exhaust stroke and long expansion stroke. FIG. 18 makes this clear.

FIG. 21 illustrates a novel cylinder head for axial cam operated piston engines of two cycle or four cycle mode of operation said head intended for the engine illustrated in FIG. 19 as an alternative. Intake and exhaust valves are normal poppet valves axially aligned with the cylinders, and conventionally ported and biased by conventional spring means. L-shaped rocker arms are provided with axially oriented shaft like extensions to rotatably and slidably carry a spherically radiused roller. Intake valve rocker arm 90 pivots on a tangentially oriented fulcrum pin, or ball stud, 91 while the radially oriented lower arm is provided with regular threaded valve stem engaging means, for tappet clearance adjustment. Spherically radiused rocker arm roller 92 engages a spherically radiused groove in combined radial valve cam 93. A rise in said groove constitutes the intake valve lobe. By sliding slightly on the shaft like extension, full line contact is maintained between the roller surface and the cam lobe during valve actuation; the sideways sliding action of roller 92 also allows said roller to seek the center of the groove in cam 93. The exhaust valve rocker arm 94 is provided with a longer axially oriented shaft like extension, or is raised, to engage a second groove in combined radial valve cam 93, said second groove comprising the exhaust valve lobe, similar in principle to the intake valve lobe just described. An "underhand" arrangement of an inverted rocker arm and short push rod arrangement is also shown as an alternative. Combined radial valve cam 93 is mounted directly on main shaft 95 which carries axial power cam 87.

Figure 23:
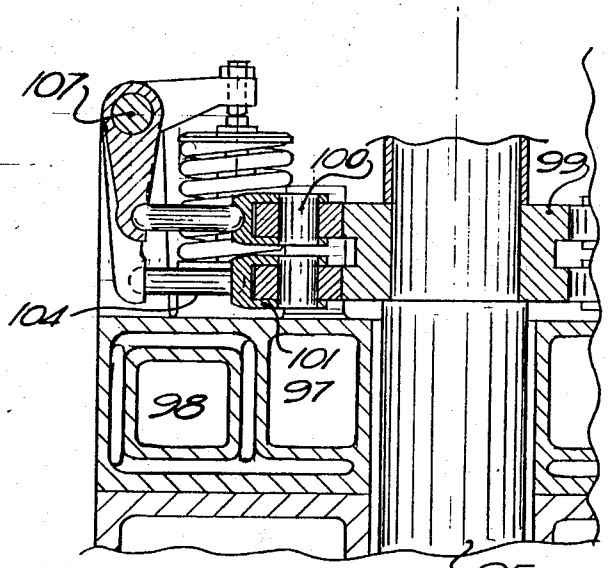
FIG. 23 is a cross section taken on plane J—J in FIG. 22, showing the stacked mounting of roller equipped cam followers.
Figure 22:
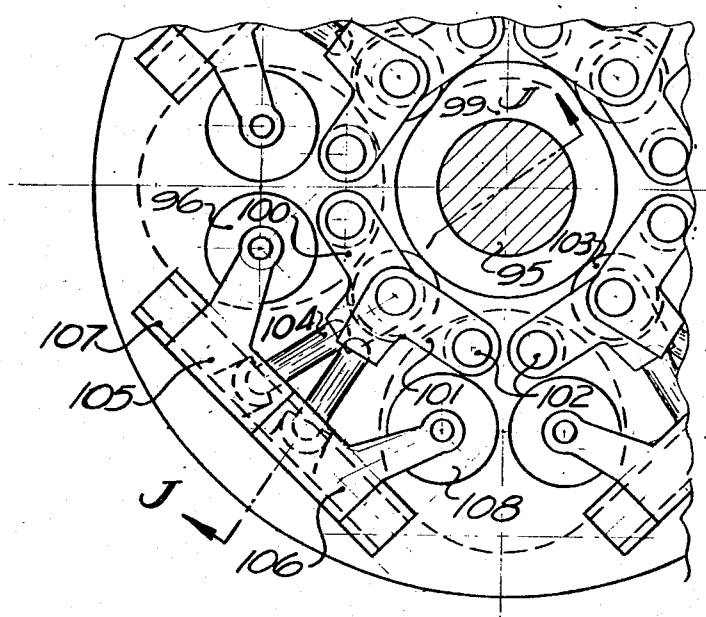
FIG. 22 is a plan view, partial in extent, of an alternative cylinder head to the cylinder head shown in FIG. 21, again employing conventional poppet valves.

FIGS. 22 and 23 illustrate an alternative to the cylinder head shown in FIG. 21. Conventional poppet type intake valve 96 and exhaust valve 108 are axially disposed, conventionally spring biased and ported, with all intake ports collectively communicating with intake torus duct 97 and all exhaust ports communicating with exhaust torus duct 98, both cast coaxially and integrally in the cylinder head. Combined radial valve cam 99 is mounted directly on main shaft 95 and is provided with stacked intake valve and exhaust valve lobes. Intake cam follower rocker 100 and exhaust cam follower rocker 101 are stacked, radially in plane with their respective cam lobes, and are pivotally supported on axially arranged rocker pins 102, which are mounted in the cylinder head casting. Said follower rockers 100 and 101 are bifurcated and provided with rollers 103, engaging respective cams, and spherical cups to engage short pushrods 104, which are ball ended. Intake valve rocker 105 and exhaust valve rocker 106 are pivotably supported on a common tangentially disposed rocker shaft 107, which is supported between two towers cast integrally with the cylinder head. Each said rocker 105 and 106 comprises an integral arrangement of a short torque tube provided with a horizontal arm on one end to engage the end of the valve stem by means of a threaded adjustable tappet, and provided with a second downwardly directed vertical arm on the other end, said vertical arm ending in an inwardly directed spherical cup, said cup engaging the outward end of pushrod 104. The arrangement is extremely compact, low in profile, promising excellent longevity, and is readily serviced and adjusted. Application of axially disposed conventional poppet valves to all forms of axial power cam axial piston internal combustion engines, and actuated by axially acting cams directly as shown in FIG. 1, or by rockers as shown in FIGS. 21, 22 and 23 is included in the scope of this invention.

Figures 24, 25:
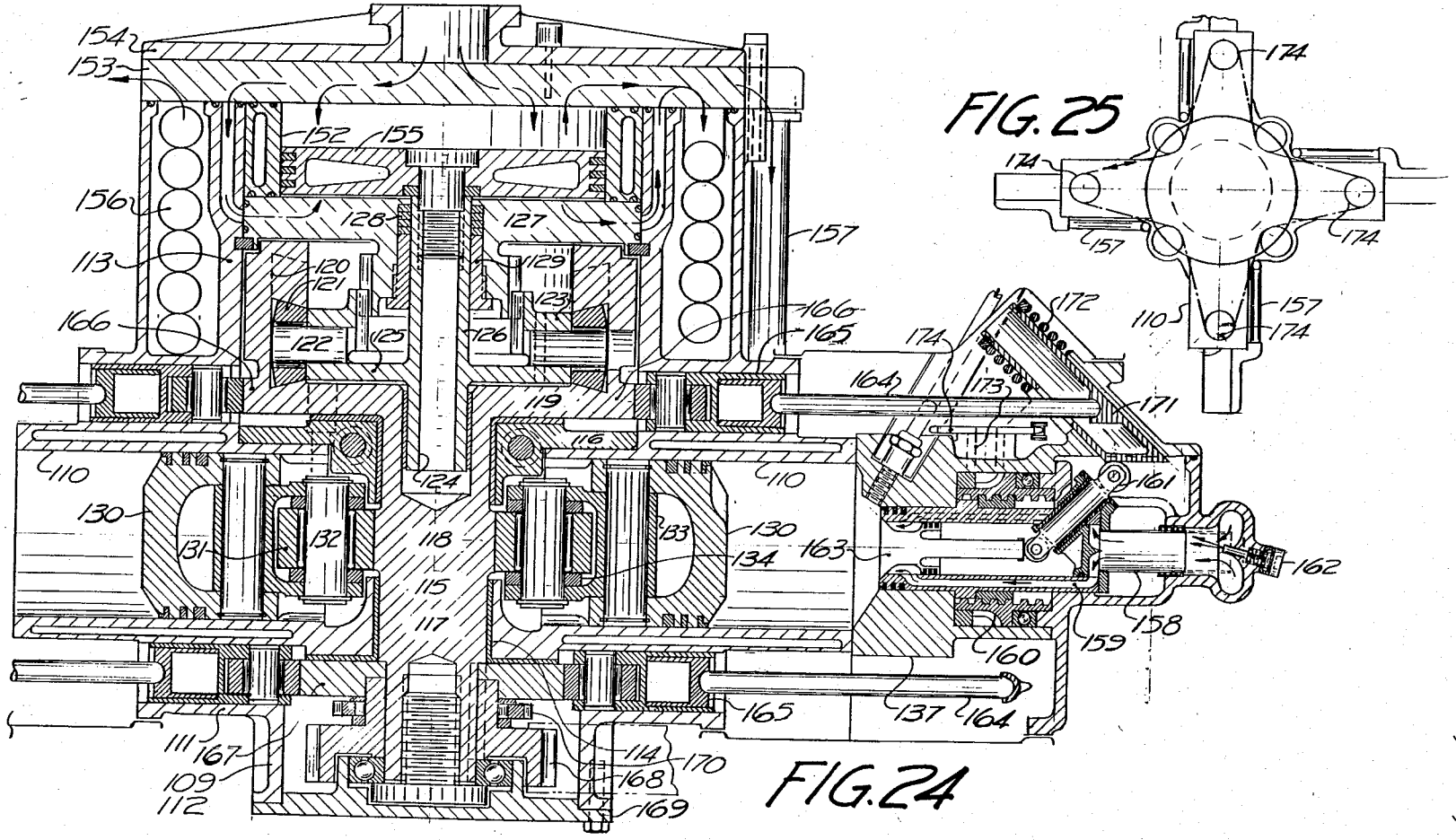
FIG. 24 is a transverse cross section of the single row, radial cylinder, radial cam version of the invention, showing the radially deployed power pistons etc. and the axially driven and axially mounted single stage charge pre-compressor with integrated after cooler.
FIG. 25 is a plan view of the engine shown in FIG. 24 and shows the layout of the drive chain for actuation of the mini reciprocating cylinder head upper travel limiter and also showing the location of the charge transmission tubes.
Figure 26:
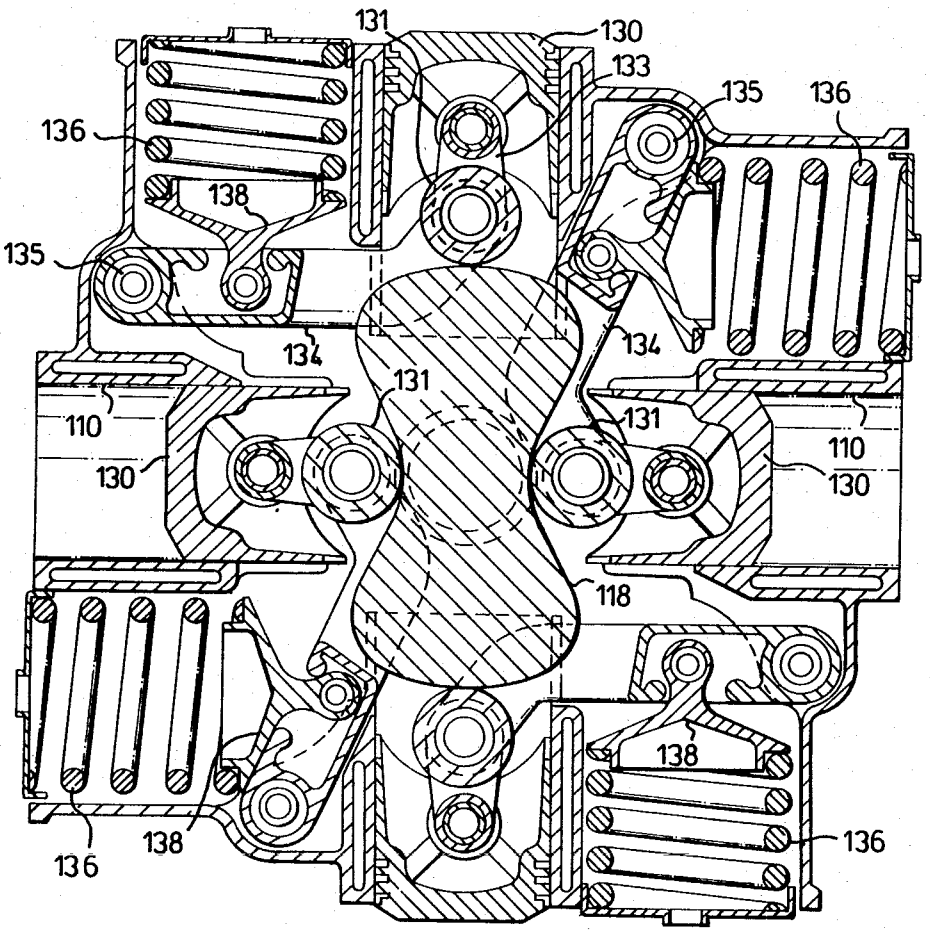
FIG. 26 is a cross section of the engine shown in FIG. 24, taken laterally across the horizontal centerplane of the engine.

Turning now to the radial power cam driven versions of this invention, FIG. 24 is a cross section taken on the transverse longitudinal cross section of a two cylinder, or four, cylinder single row, radial cylinder engine, based on the novel three cycle mode of operation. The opposing cylinders either one pair, or two pairs, as shown in FIG. 25, are integrated in a one piece engine casing 109. Casing 109 also incorporates integrally the support housing for the single stage axially disposed charge pre-compressor, said support housing being coaxial with the long axis of the main shaft of the engine, and in actuality comprising of the integrated coolant jacket for the charge cooler. The object of this embodiment is to provide a flat "pan-cake" engine which may be installed low under the hood of a compact car, leaving sufficient room above the engine to carry the spare tire for the vehicle. This is an advantage, both as crash protection as well as saving space in the interior of the vehicle. The output speed of this embodiment is one-fourth the output speed of a conventional engine for an equal number of power pulses and substantially less torque multiplication will be required, again saving space. One piece engine casing 109 comprises cylinders 110, power cam case 111, power output case 112 and pre-compressor support case 113, latter case 113 also defining the coolant jacket for the charge cooler. Casing 109 is provided with two plain main bearings 114 which rotatably support power cam shaft 115. The "top" or "front" main bearing is supported coaxially in a removable annular bearing support plate 116 which is precision spigotted into power cam case 111, being retained by screwed countersunk fasteners. Said plate 116, is transversely split, as is the "top" main bearing, to allow installation on radial power cam shaft 115, and is joined together by two large machine bolts, as shown in FIG. 24. Said plate 116 is installed on shaft 115 before latter shaft 115 is inserted in case 111. Holes in appropriate locations in radial power cam shaft 115 allow installation of countersunk fasteners to retain bearing support plate 116. Said shaft 115 is an integrated unit of a main shaft 117, as are a radial power cam 118, preferably double lobed and an integrated flywheel and compressor axial drive cam drum 119. Said drum 119 contains an undulating groove in the inside cylindrical surface said groove defining an axially acting compressor drive cam profile 120, with two rises and two falls for a two cylinder engine and with four rises and four falls for a four cylinder engine. For a two cylinder engine, two compressor drive rollers 121 or for a four cylinder engine, four compressor drive rollers 121, closely fit profile 120 and are inserted into profile 120 by means of a "loading" notch, identical in principle to the "loading notch" in conventional deep groove ball bearings and being located opposite to the "active surface" at a location on the profile where rollers 121 always bear against one side of the profile, said "bearing" side being the "active surface". Compressor drive rollers 121 are rotatably supported on cantilevered roller shafts 122, which are radially supported symmetrically by compressor reciprocator drum 123. Said drum 123 comprises an integrated assembly of an axial guide shaft 124, reciprocally and coaxially supported in a coaxial guide bore in main shaft 117, roller support plate 125, and compressor piston rod 126. Coaxial internal splines on said drum 123 match and slidably mate with coaxial external splines provided on a cylindrical bottom extension on bottom compressor head 127. Said head 127 also coaxially carries piston rod seals 128 and piston rod guide bushing 129, latter bushing being precision spigotted into head 127 and also retaining seals 128. Rotating motion of radial power cam shaft 115 will be converted to two or four short axially reciprocating strokes for the charge pre-compressor. The substantial rotating mass of the compressor axial drive cam drum 119, together with the substantial mass of the radial power cam 118, constitutes sufficient WR2 to eliminate the need for a separate flywheel. Radial power cam 118 is driven to rotate by the reciprocating motion of power pistons 130, by way of main roller 131, main roller pin 132, bifurcated piston connecting link 133 and a bifurcated thrust radius arm 134. Briefly referring to FIG. 26, said arm 134 is pivotably supported in engine casing 109 by means of thrust arm support pin 35. Said pin 135, is parallel with the axis of the engine and is located on a plane which is normal to the axis of the cylinder, said plane located half way between the bottom and top positions of the center of main roller 131. The arc described by the main roller deflects the piston connecting link so slightly that practically no piston side thrust is generated and pistons may be lighter than normal. The profile on cam 118 is compensated to allow for said arc. Radial power cam 118 is symmetrically double lobed (although a single lobed or multiple lobed profile may also be used) to provide four piston strokes per revolution, power pistons 130 being uniformly accelerated and decellerated during each stroke, resulting in a minimum inertia force. The radial profile is further designed to retain power pistons 130 in the top position of their stroke for a sufficient length of time to allow high pressure charge admission and complete combustion at constant combustion chamber volume, it being known that constant volume combustion gives highest thermal efficiency. It is known that conventional small four cycle engines at 4000 rpm and at 2000 firing strokes per minute require a maximum of thirty degree ignition advance for efficiency. Thirty degrees amounts to one-twenty fourth of the rotational angle of 720 degrees required for one power stroke in said conventional engine. The embodiment of this invention shown in FIG. 26 rotates at 1000 rpm for 2000 firing impulses per minute. Constant volume combustion, therefore requires one-fourth of 30 degrees or 7.5 degrees of main shaft rotation. The piston retention shown in FIG. 26 is 45 degrees; this leaves 37.5 degrees for constant volume high pressure charge admission, which is more than adequate, keeping in mind the high pressure of the charge. For comparison, modern two cycle engines of small size may have 90 degrees of very low pressure scavenging, yet sufficient charge is inducted to achieve a combustion pressure which is approximately 60 to 70% of a four cycle engine's combustion pressure. The embodiment shown in FIG. 26 would have a charge admission period of $2\times3.75=75$ degrees since the main shaft turns at one-half the speed of our comparable conventional two cycle engine. It is obvious that 75 degrees of very high pressure charge admission compares very favourably with 90 degrees of extremely low pressure charge scavenging. There is no doubt that the novel three cycle concept may achieve equal or better charging of the combustion chamber than conventionally aspirated four cycle engines. For fuel efficiency, the charge pre-compressor would have a displacement considerably less than the displacement of the power pistons, so that deep expansion at "wide open throttle" may be achieved improving the theoretical thermal efficiency substantially compared to a conventional engine. Additionally the constantly high pressure, low temperature extremely high density charge is admitted in a proportionally smaller initial combustion chamber volume as the power is reduced, resulting in substantial improvement of expansion ratios and thermal efficiencies at reduced power outputs, contrary to conventional engines which at compression ratios below 9 to 1 are known to have reduced thermal efficiencies at reduced outputs. The cooled charge would result in lower peak temperatures while, finally the top side of the double acting charge pre-compressor may be continually unloaded, by means of simple solenoids acting on the self acting air inlet cartridges carried by the top head, and be activated in case of emergency, practically doubling the charge output and the power output, albeit at lower efficiencies.

Similarly to the axial power cam version disclosed in FIG. 1, the radial power cam version of this engine may combine the following desirable characteristics: Low nitrous oxides emissions due to the low peak temperatures, high fuel efficiency due to extremely high expansion ratios and constant volume combustion with a favourable shape and surface area situation for the combustion chamber, continuously improving thermal efficiencies as the power output is reduced, built in power reserve for emergency situations, low friction due to elimination of piston side thrust, low oil consumption due to elimination of negative pressure in the combustion chamber, high torque low shaft speed output, eliminating several gear ratios and potentially eliminating the need for a final reduction in vehicle applications, zero radial loading of the engine's main bearings, due to symmetrical loading of the double lobed radial power cam, low muffling or no muffling requirement due to nearly complete expansion in the fuel economy mode (the emergency power mode would create substantial exhaust noise); easy cranking for start up due to virtually zero compression pressures at start up, (the charge pre-compressor discharges into a relatively large volume charge transmission ducting system), stratified charging ability without additional provisions (by directing the fuel injection off-center, to be disclosed later), perfect dynamic balance with no extra balancing means (except for a small unbalanced couple to be disclosed later), automatic take-up of "big end bearing play" (to be disclosed later), compact envelope size, no flexing bends as in crankshafts, simple staight power flow, simple one piece engine casing, simpler machining and assembly, no main bearing caps, virtually no secondary imbalances or connecting rod angularity balance problems; readily manufactured and maintained with present technologies; no exotic materials and every component fully predictable in design based on the present state of knowledge and experience in industry. Extra complexities basically involve the charge pre-compressor, charge cooler, charge density and temperature controls, and the more complicated cylinder heads. Normally, a double lobed radial cam, four cylinder radial engine as shown in FIG. 26 sets up fourth order inertia torque reaction due to the fact that all pistons etc. accelerate and decelerate perfectly in step.* In addition, the power impulses are in step for three cycle versions, although only two at a time. This requires a substantial flywheel to smoothen out. The present engine has substantial WR2 in the form of the perfectly balanced, radial power cam and the axial pre-compressor drive cam. A closer examination, reveals that due to the out of step movements and external deceleration means, the above * is not valid for this invention.

a. In this embodiment, the pistons in the top position remain stationary over $22\frac{1}{2}$ degrees, while the side pistons are accelerated by the mainshaft setting up positive inertia torque reaction for two pistons over $22\frac{1}{2}$ degrees.

b. The next $33\frac{3}{4}$ degrees of rotation, sees the top pistons accelerate by external means, with no inertia torque on the main shaft. During this period, side pistons continue acceleration over $11\frac{1}{4}$ degrees, continuing the positive inertia torque reaction of period (a). After this the side pistons decelerate over $22\frac{1}{2}$ degrees by external means, setting up no inertia torque reactions in the main shaft.

c. The next $33\frac{3}{4}$ degrees of rotation see the top piston decelerated in step, setting up a negative inertia torque reaction for two pistons over $33\frac{3}{4}$ degrees. During this period the side piston continue deceleration by external means, over $11\frac{1}{4}$ degrees, setting up no inertia torque reaction in the main shaft. After this, the side pistons remain stationary over $22\frac{1}{2}$ degrees to reach top dead center.

The above inertia torque reactions are summarized as follows:

| Degrees of Rotation | Resultants | |
|---|---|---|
| | Shaft | Mounts |
| First $22\frac{1}{2}$ | +2 pistons | −2 pistons |
| Next $11\frac{1}{4}$ | +2 pistons | Zero |
| Next $22\frac{1}{2}$ | Zero | Zero |
| Next $11\frac{1}{4}$ | −2 pistons | Zero |
| Next $22\frac{1}{2}$ | −2 pistons | +2 pistons |

Fourth order inertia torque reactions are not present.

The retention of the pistons in the top dead center position therefore, is not only beneficial for three cycle high pressure charging and constant volume combustion, but also for creaking up in-step inertia torque reactions, helping to reduce fourth order reactions to second order reactions. For two cylinder in-line engines the above resultants also apply; although resultants should be expressed in single piston masses; the doubled piston speeds bringing the results back in line with the above resultants.

| Engine characteristics of novel three cycle or two cycle engines of this invention at equivalent number and volume of expansions 3 inch stroke. | | | | |
|---|---|---|---|---|
| | | 4 cylinder rad cyl. 4 cyl. in-line flat | 2 cylinder in-line | |
| Parameter | 4 cylinder conventional | double lobe 90 deg. phased | double lobe 90 degphase | single lobe 180 dg. phased |
| rpm | 4000 | 1000 | 2000 | 4000 |
| piston strokes p min | 4 × 8000 = 32000 | 4 × 4000 = 16000 | 2 × 8000 = 16000 | 2 × 8000 = 16000 |
| power impulses per min. | 4 × 2000 = 8000 | 4000 at 90 deg. | 2 × 4000 = 8000 at 90 deg | 2 × 4000 = 8000 at 180 deg. |
| expansions volume & number involved p min | 1 × 8000 | 1 × 8000 | 1 × 8000 | 1 × 8000 |
| piston speed fpm | 8000 × 3" = 2000 fpm | 4000 × 3" = 1000 fpm | 8000 × 3" = 2000 fpm | 8000 × 3" = 2000 fpm |
| total piston travel | 32000 × 3" = 8000 ft/min | 16000 × 3" = 4000 ft/min | 16000 × 3" = 4000 fpm | 16000 × 3" = 4000 fpm |
| pre-compressor piston strokes | — | 4000 × $\frac{7}{8}$" | 8000 × $\frac{3}{4}$" | 16000 × $\frac{1}{2}$" |

Note: The single lobed cam versions would have counterweights at the fore and aft end of the main shaft to counterbalance the single cam lobes, said counterweight also may be sized to counterbalance the piston free force couple. This would introduce small secondary imbalances. A single lobed, counterbalanced V-4 version will have a 90 degree power impulse spacing, like a conventional V-8; and will have balanced inertia torque main shaft forces, with the back and front pistons in one in-line bank accelerating and the remaining cylinders decelerating, with excellent primary free force balance.

Returning now to the description of the embodiment; one of the objects of the invention is to provide a radial power cam of simple robust construction, eliminating the usual grooves in the front face, or both faces, for purposes of a cam follower roller, which returns the power pistons to the bottom position. A substantially lower engine profile also results if said groove or grooves are eliminated. Calculations indicate that a power piston and roller assembly of 1.5 pounds will require a retarding force of 200 pounds at 2000 firing impulses per minute, equivalent to 4000 rpm for a conventional small four stroke engine. This retarding force may be provided by an external spring means acting on the thrust radius arm 134. The spring bias means is shown as numeral 136 in FIG. 26, thrust arm compression coil bias spring. Said spring 136 is seated against a cantilevered extension on the cylinder heads 137 and are seated on the bottom on bottom spring seat 138, a lightweight conical seat, pivotably supported by thrust radius arm 134.

The next alternative spring bias means shown in FIG. 26*a* is coil torsion spring 140 coaxially mounted on a small rotatable spring support drum 141; said drum 141 is supported on a coaxial shaft. Spring 140 comprises of a LH wound half and a RH wound half, connected together by an axially directed bend in the spring wire, with both outside free ends reacting against and supported in lugs cast integrally on the bottom of a lateral web extending sideways from the cylinder head 137. A conventional small connecting rod 142, provided with a split bushed big end, and a ball ended small end, connects torsion spring 140 with thrust radius arm 134. A cutout in drum 141 accommodates the big end of connecting rod 142. Reciprocating motion of connecting rod 142 is converted to rotary oscillating motion of spring support drum 141. A conventional hairpin coil torsion spring may also be employed, and would have less inertia but require more space.

A further alternative spring bias means is a gas spring or gas cylinder spring means shown in FIG. 26*b*. Gas spring cylinder 143 is cast integrally parallel to the power cylinder, and reciprocally disposes a small piston 144 of self-lubricating material and provided with self lubricating seal rings. A ball ended connecting rod 145 connects piston 144 with a spherical socket in the top of thrust radius arm 134. An Adiprene (Reg. Trademark of Dupont Inc.) elatomer safety cushion is incorporated in the top of cylinder 143; normally piston 144 clears said elastomer cushion. A ball check valve supplies the compression chamber in cylinder 143 with air, but prevents escape of trapped air. Heat will not build up in cylinder 143, since adiabatic compression will be followed by adiabatic expansion. An auxiliary hairpin torsion spring 146 reciprocates power piston 130 at cranking speeds. Other gas spring means such as bellows etc. may be used.

A further alternative positive piston return means comprises a radial cam means shown in FIG. 26i c. A camshaft, which may be the valve cam shaft if the engine is equipped with a cylinder head mounted camshaft, or camshafts, carries a special "deep stroking" auxiliary radial cam 147, which is actuated in time with the power pistons; said cam 147 engages a roller 148, mounted on the bifurcated ends of a special large heavy duty hydraulic cam follower 149, which is reciprocally carried in a special bore adjacent to the power cylinder, and which is connected to the thrust radius arm 134 by means of a heavy duty ball ended push-rod 150. Engine oil under pressure pressurizes the hydraulic cam follower 149 by way of an externally mounted and accessible ball check valve. A heavy duty compression coil spring is incorporated inside said cam follower 149 to extend the piston of follower 149. It is known, in the art relating to automotive maintenance, that check valves in hydraulic cam followers are the main cause of failure. By external mounting, servicing is greatly facilitated. An adjustable elastomer cushion 151, prevents damage to the power piston and exhaust valve in case of complete failure of any of the pistion return means disclosed. Note that hydraulic cam follower 149 will allow development of only a few thousandths of an inch "play" in the control of power piston reciprocation in case of total failure of said follower 149, due to internal seating of the hydraulic cam follower piston. Note that this piston return means also automatically "takes up" all "slack" or "play" developed in the thrust radius arm means, a very desirable feature.

Returning to FIG. 24, pre-compressor support case 113, is precision bored to coaxially support bearing support plate 116, bottom compressor head 127 and pre-compressor cylinder 152. A heavy duty precision ground "snap" ring is installed in a groove in the bore of said case 113, to form a ledge seat for said head 127, which traps said "snap" ring by means of a coaxial collar. A pan-cake type top compressor head 153 spans across cylinder 152 and case 113, to trap said cylinder 152 and said head 127, and encloses the top of the integral coolant jacket surrounding said support case 113. Cover plate 154 covers all channels and self-acting valve cartridges in top compressor head 153 and is provided with a central air inlet opening. Pre-compressor piston 155 is bolted coaxially to the top of compressor piston rod by a spigotted threaded fastener and incorporates a thick, hardened steel precision ground load distributor washer, to avoid crushing the light alloy of piston 155. After-cooler 156 comprises a coiled tube, coaxially installed within the coolant jacket; after cooler 156 is swaged, or otherwise permanently installed into the bottom face of top compressor head 153 at both inlet and outlet ends and therefore becomes an integral part of head 153. The top surface of the coolant jacket is provided with an annular coaxial opening to allow lowering into, and raising out of, said coolant jacket, of said after cooler 156. Charge transmission tubes 157, L-shaped, transmit the cooled pre-compressed high density charge to the bottom face of the cylinder heads 137, from where a duct, cast integrally, carries said charge to the top of said head 137 for induction into the top end of charge snorkel tube 158, a short reciprocating tube, which is carried by mini reciprocating head 159. Said head 159 is identical in principle and action, to the mini reciprocating head as disclosed for FIG. 1, except that the upper travel limiter assembly 160 is coaxially installed below charge admission valve actuator 161, as clearly shown. Fuel injector nozzle 162 is off-set to direct the fuel towards the spark plug top—the result will be stratified charging with an extra rich mixture near the spark plug tip and gradually leaning out from there. The invention allows extremely simplified stratified charging. Momentarily returning to the charge pre-compressor, the inlet air is introduced to the bottom compressor head 127 by way of channels cast in pre-compressor support case 113, as shown, and similarly is discharged from said head 127 by similar channels. A multitude of small cartridge type self-acting inlet and discharge valves is carried by heads 127 and 153 and air is channeled as shown by arrows in FIG. 24. All pre-compressed air passes through the aftercooler 156, before being distributed to the cylinder heads, but a thermostatically controlled bypass valve will be advantageous for warming up and emission purposes especially in colder climates. Constant density of the charge is controlled by pressure and temperature sensors, and the charge pre-compressor is controlled by unloading the air inlet valves or by throttling. Solenoids may permanently unload the inlet valves in the top pre-compressor head 153, to provide an emergency power boost capability as disclosed for FIG. 1. A second stage compressor and after cooler may be added in top of the double acting charge pre-compressor shown, as disclosed for the engine in FIG. 1, to achieve higher densities at greater efficiency.

The charge admission valve 163 and the two or four exhaust valves per cylinder of conventional poppet variety, are controlled by pushrods 164, actuated by hydraulic cam followers 165, bifurcated and roller equipped, and engaging charge admission cam 166 and separate, coaxially mounted exhaust valve cam 167. Said cam 167 is keyed to main shaft 117 and retained by power output sprocket 168, which is provided with a silent Hy-Vo (Reg. Trademark Morse Corp.) power output chain. To reduce overhung loads on the main bearings, a ball bearing is mounted on main shaft 117 and is supported by closing cover plate 169. The hub of sprocket 168 is hardened and precision ground to support starter gear 170, which is equipped with a free wheeling one-way sprague clutch. Said gear 170 mates with another idler gear (not shown), with said idler gear engaging the output gear of the starter motor (not shown), which is mounted in the crotch between the cylinders.

The conventional poppet type exhaust valves (not shown), are engaged by conventional valve rockers carried by the cylinder head. Pushrod 164, for charge admission, are actuated by charge admission cam 166 which is integral with compressor axial drive cam drum 119. Pushrod 164, for charge admission, on the top end engages the top interior surface of charge admission valve actuator plunger 171, by means of an interior spherically radiused socket, as shown. Said plunger 171 is reciprocally carried by a bore in cylinder head 137. Said bore being arranged at an acute 45 degree angle relative to the axis of cylinders 110, on a plane which is parallel to the axis of the power cylinders 110. Plunger 171 is provided with a flat actuating surface which is parallel with the axis of cylinders 110. An outboard roller on charge admission valve actuator 161 permanently contacts said flat actuating surface, but is free to roll up or down as mini reciprocating head 159 reciprocates in its bore, therefore, maintaining accurate timing for charge admission valve 163 regardless of the position of mini reciprocating head 159.

By engaging the top interior surface of plunger 171, push rod 164 keeps plunger 171 stabilized in its bore and prevents rotation of said plunger 171. Plunger return spring 172 biases said plunger 171 in outward direction, ensuring extremely quick retraction of plunger 171, required for fast operation of the charge admission valve 163.

The upper travel limiter assembly 160, is identical in principle and arrangement to the upper travel limiter assembly disclosed for the engine in FIG. 1. The worm gear is engaged by a short worm teeth equipped upper travel limiter drive shaft 173, equipped externally by sprocket 174. Sprocket 174 is engaged by a light roller chain, which mutually engages all upper travel limiter drive sprockets and which loops under idler sprockets located at the bottom junction of the cylinders, as shown in FIG. 25, said figure being a "top" view of the engine (the engine of FIG. 24 is of "vertical" shaft variety). One of said idler sprockets is connected to the power output regulator of the engine. A backfire relief valve is incorporated in the charge transmission ducting; not shown. Further details of cylinder head 137 will be disclosed later in FIG. 36. As with the engine shown in FIG. 1, the power pistons of this version approach the roof of the expansion chamber very closely, being shaped to clear the still slightly open exhaust valves. Combustion takes place at constant volume within the bore for the mini reciprocating head 159, hence the "normal" combustion chamber in the cylinders is referred to as the "expansion" chamber in this disclosure.

Figures 27, 28, 29:
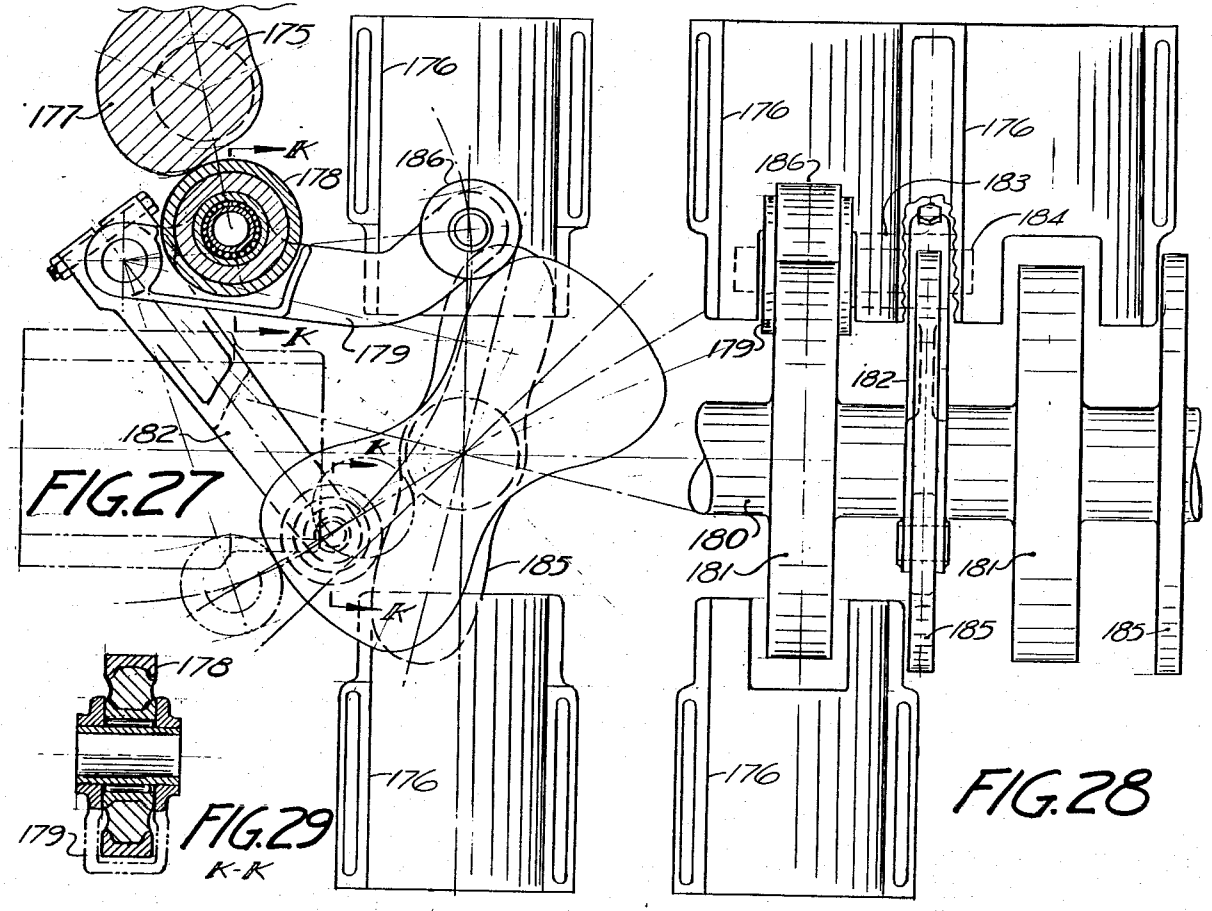
FIG. 27 is an identical view as shown in FIG. 26, and shows two more alternative piston return means.
FIG. 28 is a side view of the mechanism shown in FIG. 27.
FIG. 29 is a lateral cross section of the thrust radius arm return rollers shown in FIG. 27.

Referring now to FIGS. 27, 28, 29, 30, 31 and 32, there are shown details of an in-line version of the engine disclosed in FIGS. 24, 25, 26. The sixth alternative piston return means comprises a camshaft 175, which may also serve as the valve camshaft, is mounted alongside each in-line bank of power cylinders 176, and is provided with a special radial cam 177 to engage a heavy duty, elastomer cushioned piston return roller, 178 which is rotatably supported between the webs of thrust radius arm 179 near its fulcrum point. Camshaft 175 is in positive rotational relationship with main shaft 180, while cam 177 is profiled to reciprocate power piston 130 in exact synchronization with the profile on radial power cam 181 which is identially profiled to radial power cam 118 in FIG. 24. The piston return roller 178 is pre-loaded to bear solidly against the profile on cam 177, while the elastomer cushion, coaxially bonded between the hub and rim of roller 178 takes up any manufacturing inaccuracies, reduces noise and prolongs longevity of all components. Being "externally" mounted, roller 178 may be readily serviced; FIG. 29 illustrates roller 178, said roller 178 may be a solid roller also.

The seventh alternative piston return means, also illustrated in FIGS. 27, 28, 29, comprises roller 178, mounted on the bifurcated end of auxiliary radius arm 182, which in turn is mounted on a torque tube extension 183, coaxially disposed around fulcrum pin 184 for thrust radius arm 179, said extension 183 being integral with said arm 179. Between power cylinders 176, a special piston return cam 185 is integrally mounted on main shaft 180 and roller 178 is in continuous engagement with the profile of cam 185. The profile on piston return cam 185 is such that the motion of roller 178 is in exact synchronization with the motion of main roller 186, while main shaft 180 rotates. The elastomer cushion within roller 178, accommodates any innaccuracy in manufacture, roller 178 being pre-loaded against the cam profile. External mounting of auxiliary radius arm 181, by means of a clamped connection, allows ready removal of any "play" in the system.

Figure 30:
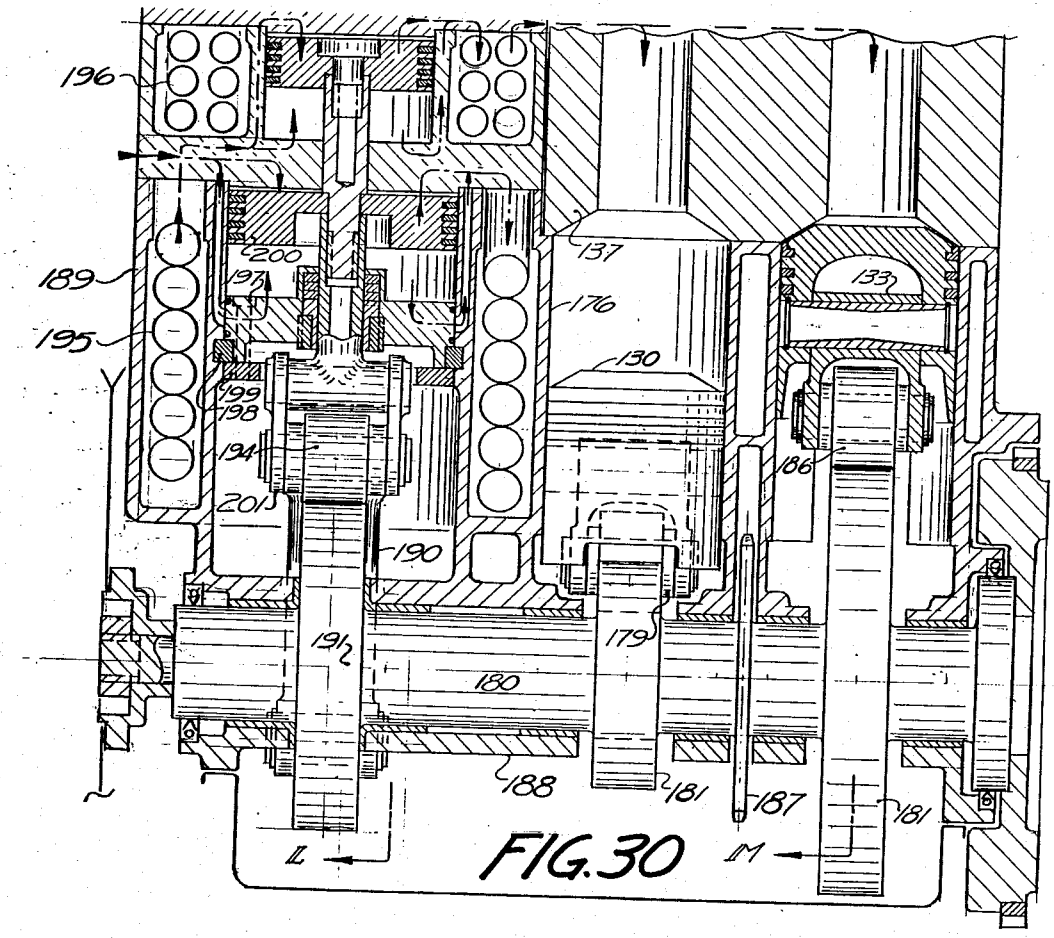
FIG. 30 is a cross section taken on the longitudinal centerplane of a two cylinder in-line radial power cam operated version of the invention, employing a radial cam operated doubling acting two stage charge pre-compressor with integral inter and after coolers.

FIG. 30 illustrates a two cylinder in-line version of the engine disclosed in FIGS. 27, 28, 29. Main shaft 180 is perfectly dynamically balanced, radial power cams 181 are 90 degrees out of phase, giving a power impulse every 90 degrees of main shaft rotation. The power pistons are statically balanced but will set up a rocking couple, which may be taken care of by elastic mounting of the engine, or by a couple of counter-rotating phased balance shafts running at twice engine speed.

An equivalent four cylinder, four cycle engine, at an equal number of power impulses per cylinder, say 2000 p.i.p.m. (power impulses per minute), will give 8000 p.i.p.m. at 4000 rpm, spaced at 90 degrees. The illustrated embodiment will give 4000 p.i.p.m. at 1000 rpm, spaced at 90 degrees, at one-half the piston speed of the "equivalent" four cycle engine. At equal piston speeds, the illustrated embodiment will give 8000 p.i.p.m. at 2000 rpm, spaced at 90 degrees. A "flat four" version of the invention, at one-half the piston speed of the "equivalent" four cylinder, four cycle engine, would give 4000 p.i.p.m. at 1000 rpm, spaced at 90 degrees, and would be perfectly balanced, except for minor secondary couples created by the external piston return means. A V-four version of the invention, at one-half the piston speeds of the equivalent four cycle engine, will equal the flat four version, but will set up rocking couples similar to the two cylinder in-line version. By using counter-balanced single lobed radial power cams, the embodiments of this invention will increase the output speeds by a factor of two, with a doubled main roller speed. By suitable selection of number of power cam lobes, power cylinder arrangement, and balancing measures, a great number of alternative engines may be arrived at.

Figure 31:
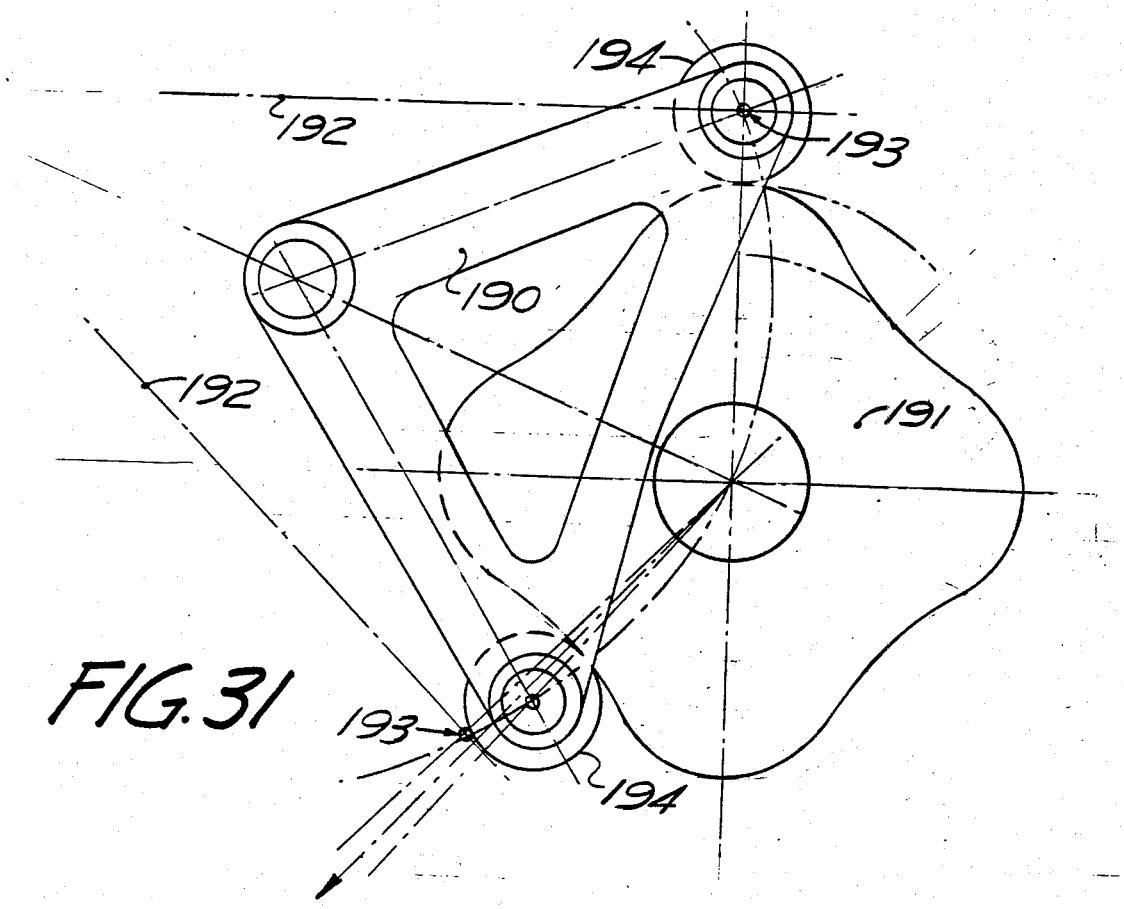
FIG. 31 shows the principle of novel double acting motion converting mechanism used to operate the double acting charge pre-compressor shown in FIG. 30. One revolution of rotary motion is converted to four positive reciprocating strokes.

In FIG. 30, centrally carried camshaft drive sprocket 187, drives the single or double cylinder head mounted valve cam shaft or shafts at twice engine speed, said valve cam shafts being equipped with single valve actuating lobes. Main bearings 188 are conventional, split cap type. The novel embodiment of this version of the invention is the multiple lobe radial cam piston connecting means for the double acting two stage charge pre-compressor 189. In conformity with the main object of this invention, namely, to provide a novel, simple and rugged cam-to-piston connecting means which incorporates a novel thrust radius arm and which eliminates grooves in the face of radial cams, the thrust radius arm to drive the charge pre-compressor comprises of a doubled up thrust radius arm to form oscillating thrust arm rocker 190, which is illustrated in principle in FIG. 31, and which is shown as applied to the engine of FIG. 30, in FIG. 32. Referring to FIG. 31, radial drive cam 191 is symmetrically four lobed. Major diameter tangent lines 192 form an acute angle of 45 degrees; the dividing line for said 45 degree angle passes through the center of cam 191. A circle drawn through tangent points 193 and the center of cam 191 has its center located on said dividing line. Taking the center of said circle as the center of the fulcrum for thrust arm rocker 190 and by moving the second cam follower roller 194 from tangent point 193 to a position on said circle where said roller 194 contacts the valley of radial drive cam 191, symmetrical thrust arm rocker 190 is formed. Since the downhill, angular acceleration of a lobe exactly equals the uphill, angular acceleration of the valley, as well as downhill, angular decelerations and uphill, angular decelerations, both rollers of thrust arm rocker 190 maintain contact with the profile on radial drive cam 191 at all times. Said profile is compensated to allow for the radius transversed by said rollers. Note thay any "play" in the system may be taken up by moving the pin for rollers 194 along the arced path of travel for rollers 194. This novel embodiment is included in the scope of this invention.

Returning to FIG. 30, having studied the disclosures for FIG. 1 and FIG. 24, the two stage double acting charge pre-compressor 189, together with intercooler 195 and aftercooler 196 and airflows as indicated by arrows, will be readily understood. Note that bottom compressor head 197 is retained in the bore for the first stage by split ring 198 and retaining ring 199, flush, counter sunk fasteners joining said head 197 and said ring 199, as shown. By intruding the cylindrical seal enclosure of bottom compressor head into the bottom of the first stage piston 200 a shallower engine profile is obtained. Pivot link 201 connects thrust arm rocker 190 to the pre-compressor piston rod. Note that the intercooler is permanently swaged into the bottom face for the coaxially spigotted combined second stage cylinder second stage bottom head. Similarly, the aftercooler is permanently swaged into the bottom face of the second stage top head. Both coolers enter their respective coolant jackets by way of annular coaxial slots in the top faces of the respective coolant jackets. Note also that the first stage compressor cylinder is integrated in the engine cylinder block and allows a simple straight through boring operation.

Figure 32:
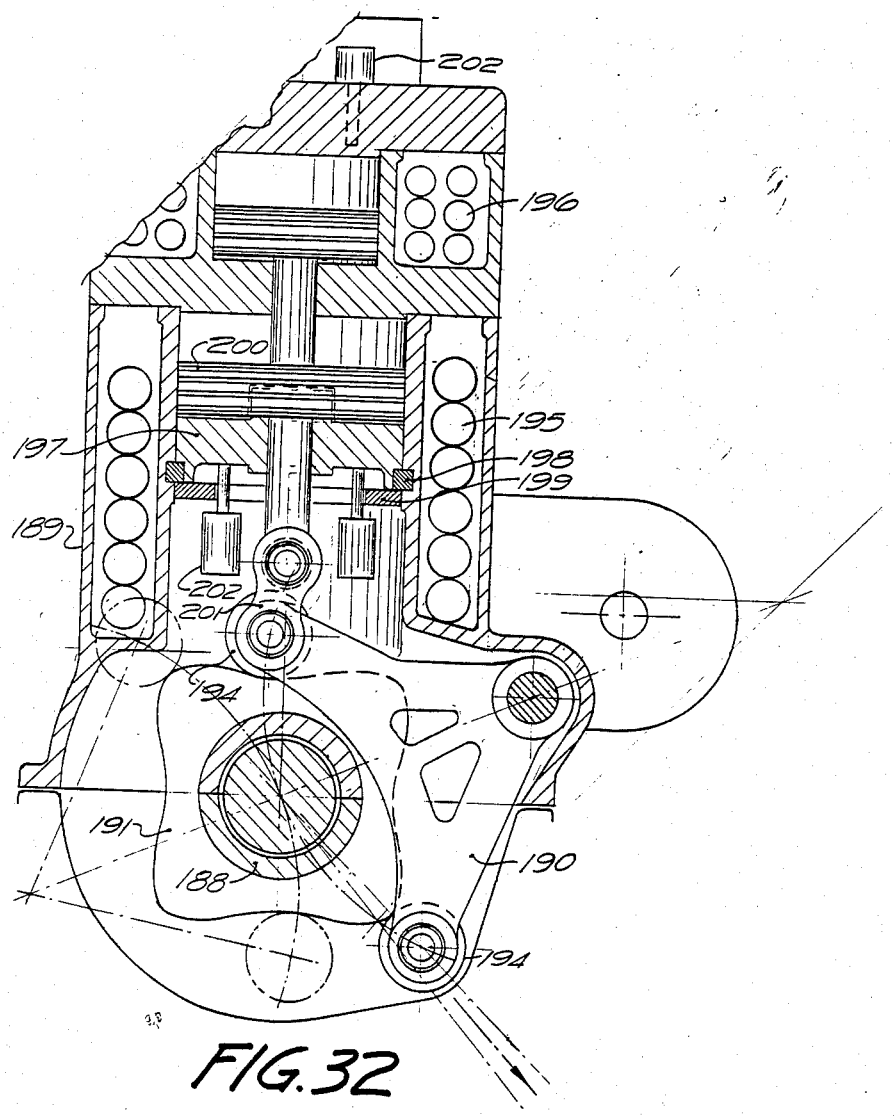
FIG. 32 shows a transverse cross section of the double acting two stage charge pre-compressor shown in FIG. 30, employing the motion converting mechanism shown in FIG. 31.

FIG. 32 shows a transverse cross section of charge pre-compressor 189 and is self-explanatory after having studied FIG. 30. Note that a second charge pre-compressor may be added in the direction of the arrow shown, the piston rod for said second charge pre-compressor picking up on the bottom cam follower roller 194, forming a shallow V block. A second thrust arm rocker, shown in phantom lines, may be operated off the same radial drive cam 191. The embodiment for the charge pre-compressor shown has a displacement for one side of the first stage which equals 55% of each power piston displacement, resulting in deep expansion for the power strokes, while the number of discharge strokes for one side of the pre-compressor equals the total number of power strokes of the engine. Solenoids 202 continuously keep the bottom side of the first stage and the top side of the second stage unloaded by acting on the self-acting air inlet valves. By de-activating said solenoids, the output of the charge pre-compressor will be doubled, greatly boosting the power output of the engine, for emergency situations. The upper travel limiter for the mini reciprocating cylinder heads would be raised accordingly to accommodate the extra charge admitted.

Figures 33, 34, 35:
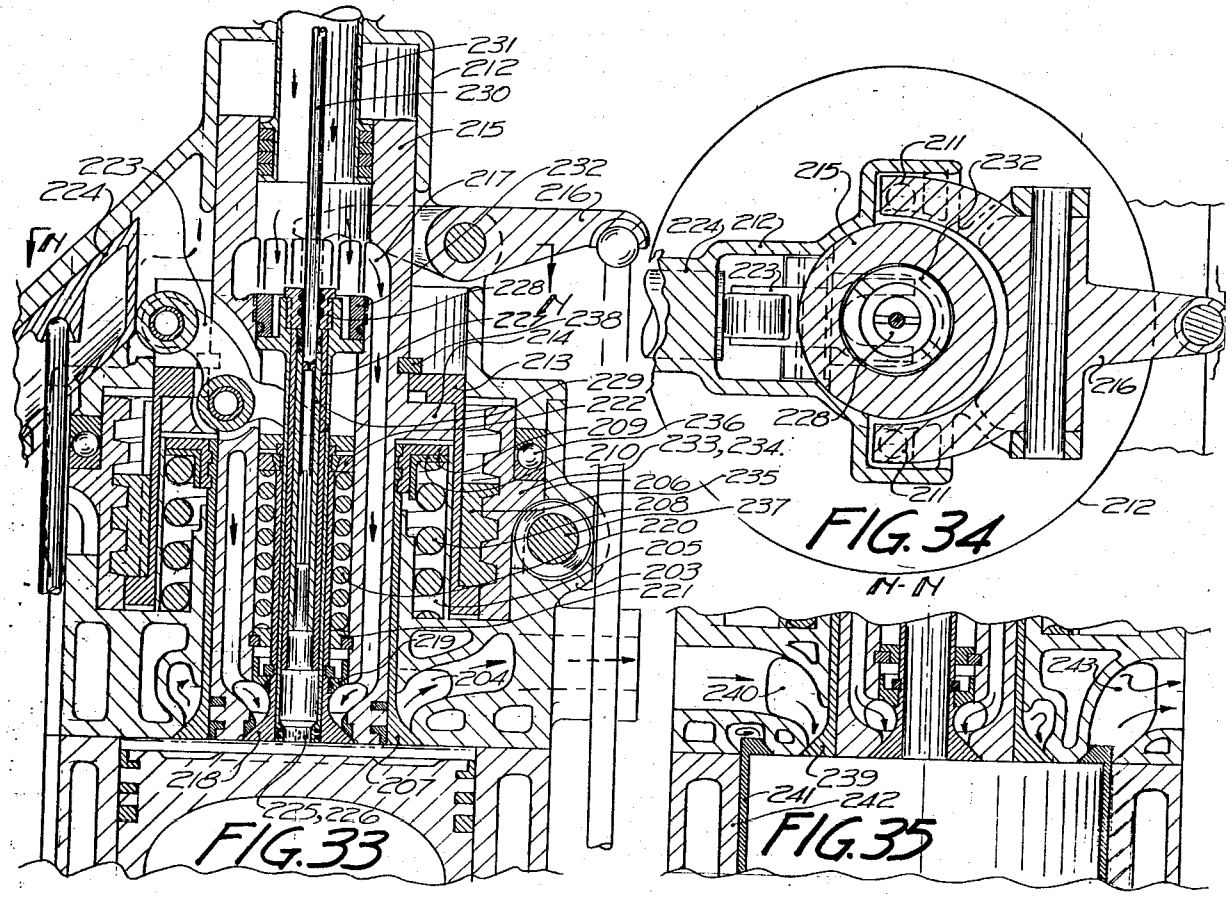
FIG. 33 shows a transverse cross section of a cylinder head which may be used with all versions of the invention.
FIG. 34 shows a cross section taken on plane N—N in FIG. 33.
FIG. 35 shows an alternative valve arrangement of the cylinder head shown in FIG. 33, employing three coaxial valves, in order to achieve highly stratified charge admission.

FIG. 33 shows an alternative cylinder head for the novel three cycle embodiments of the invention thus far disclosed, and illustrates a completely coaxial arrangement of exhaust expulsion, charge admission and ignition. Cylinder head 203 is provided with a coaxial exhaust valve guide bore, a coaxial exhaust port 204, a coaxial exhaust valve seat formed around the bottom outward edge of said exhaust port 204, and a number of coaxial blind bores from above, exhaust valve spring bore 205 and upper travel limiter bore 206. Exhaust valve 207 is of novel poppet sleeve variety. Reference may be made to our co-pending Canadian patent application no. 378-226-3; filed 81-05-25; for a description of an internal combustion engine and a poppet sleeve valve to control the aspiration of said engine. Exhaust valve 207 comprises a cylindrical sleeve with an annular coaxial outwardly directed flange around the bottom edge, said flange provided with an annular coaxial valve face on the top edge. Said valve 207 is reciprocally disposed in said exhaust valve guide bore, with said valve face seatable against said exhaust valve seat to close communication between the combustion chamber in the engine and said exhaust port 204. A coaxial exhaust valve spring 208 disposed in bore 205, engages exhaust valve 207 and urges same to the closed position by way of spring retaining ring 209, a transversely split L-shaped ring provided with two annular ledges formed on the inside cylindrical face, said ledges matching two annular coaxial grooves machined in the outside cylindrical surface of said exhaust valve 207. Spring retaining ring 209 is positively trapped in position by safety ring 210, a one piece fully annular L-shaped ring. Nearly full compression of the exhaust valve spring is required to install or remove spring retainer ring 209. This embodiment meets one of the objects of this invention, namely, to provide a simple, sure spring retaining ring for the novel poppet sleeve valves. Exhaust valve 207 is actuated by means of two pins 211, reciprocally carried by cast lugs forming part of cylinder head cover 212, said pins passing through the upper flange of travel limiter cushion sleeve 213 and through the travel limiting ledge 214 of mini reciprocating head 215, to engage the upper surface of spring retaining ring 209. Pins 211 are actuated by bifurcated exhaust valve rocker 216, a pushrod, a hydraulic cam follower and an exhaust valve cam in timed relation.

Reciprocally disposed in exhaust valve 207 is mini reciprocating head 215, a light alloy cylindrical body, provided with piston ring sealing means around the bottom, a sturdy travel limiting ledge 214, a straight through coaxial bore, an annular coaxial valve seat at the bottom inside edge of said coaxial bore, and charge by-pass ports 217. Charge admission valve 218 comprises of a basic "poppet sleeve" valve body, provided with a removable spool 219, retained by a heavy duty snap ring. The head portion of valve 218 is seatable against said annular coaxial valve seat to close communication between the combustion chamber and by-pass ports 217. Spool 219 is larger in diameter than said annular coaxial valve seat, resulting in a closing bias force exerted on valve 218 due to charge pressure in by-pass ports 217. Valve 218 is also biased to the closed position by valve spring 220, seated on spring seat 221, which is retained by, and which traps, a heavy duty snap ring as shown, said spring 220 being retained by spring retainer 222, held in place by conventional tapered conical valve keepers. Actuation of valve 218 is by means of an L-shaped bifurcated charge admission rocker 223, acting on a hardened steel cap carried by valve 218, pivotably carried by head 215 by means of a rocker pin. A cutout in the side of head 215 allows installation and removal and rocking action of rocker 223. The bifurcated vertical end of rocker 223 carries a roller, which protrudes a sufficient distance from head 215 to allow actuation of rocker 223 by charge admission plunger 224, without interference, while head 215 reciprocates. Plunger 224 is identical in execution and operation to plunger 171 disclosed in FIG. 24.

Coaxially and reciprocally disposed within the small cylindrical bore of charge admission valve 218 is the slender elongated body of spark plug 225. Said slender elongated metal body is provided with miniature sealing rings around the outside bottom edge, a large flange around the top, a straight cylindrical bore, terminating at the bottom at a conical seat, from where a smaller bore continues to the bottom tip; a threaded counterbore is provided at the extreme top. Ceramic core 226 matches the inside diameters at the bottom of said elongated metal body and seats and seals on said conical seat by means of a soft copper washer. Ceramic core 226 further comprises two coaxial, progressively smaller, cylindrical extensions at the top. A metal center electrode passes coaxially through the entire ceramic core and continues some distance upward beyond said core. A metal thin walled cylindrical sleeve 227, fitting closely inside the bore of said elongated metal body, bears on the first and lower ledge formed around ceramic core 226 and extends upward to be retained by retainer plug 228, threadably engaging said threaded counterbore. A ceramic cylindrical sleeve 229 extends from thesecond ledge on ceramic core 226 to the bottom of retainer plug 228, with a short elastomer sleeve provided between sleeve 229 and plug 228, to prevent crushing of sleeve 229. A hard insulated rod like conductor 230, coaxially disposed within charge admission snorkel tube 231, reciprocally penetrates plug 228 to terminate in a small metal sleeve, which surrounds the upward protruding end of said metal center electrode, thus establishing electrical communication, while spark plug 225 reciprocates with head 215. Spark plug retainer plug 232 threadably engages the inside bore of head 215 to lock spark plug 225 in place. Head 215 is biased downwardly by the charge pressure prevailing in snorkel tube 231, said snorkel tube being coaxially supported by cylinder head cover 212 and reciprocally sealed in the bore of head 215.

The extent of reciprocating travel of mini reciprocating head 215 is controlled by upper travel limiter 233, which comprises of travel limiter sleeve 234, travel limiter ring 235, thrust bearing 236, worm drive shaft 237, travel limiter cushion sleeve 213, which is locked onto travel limiting ledge 214, by heavy duty snapring 238. The principle and action of upper travel limiter 233 is identical to the similar embodiment disclosed for the engine in FIG. 1. Momentary rotary movement in either direction of worm driveshaft 237 rotates travel limiter sleeve 234 in either direction and raises or lowers travel limiter ring 235, said ring being keyed to cushion sleeve 213 and therefore allowed axial travel only. A bottom annular ledge on cushion sleeve 213 bottoms out on cylinder head 203 to limit the bottom position of head 215 to a fixed position, flush with the slightly open position of exhaust valve 207; the power piston is slightly dished to clear head 215 and valve 207; practically 100% exhaust expulsion is accomplished. After valve 207 is closed, valve 218 opens; the inrushing high pressure charge will bias head 215 strongly upward to seat the ledge on cushion sleeve 213 against travel limiter ring 235. The position of ring 235 therefore determines the volume of the combustion chamber, said volume determining the weight of the charge admitted; valve 218 is strongly biased to the closed position by charge pressure in the combustion chamber aiding in rapid closing. Upon closing of valve 218 the charge is ignited and combusted, at constant volume, with power piston 130 commencing the expansion stroke thereafter. Engine oil is supplied under pressure to the spaces above and below the bottom annular ledge on cushion sleeve 213, with suitable escape orifices allowing controlled cushioned movement of the mini reciprocating head 215.

FIG. 35 shows the engine disclosed in FIG. 33, except with a third poppet sleeve valve added to act as the exhaust valve, while the exhaust valve of FIG. 33 now acts as a second stratified charge induction valve. Mini reciprocating head 215, charge admission valve 218 and spark plug 225 are identical in execution and function as the similar components disclosed in FIG. 33. Air induction valve 239 is identical in execution to exhaust valve 207 in FIG. 33, and serves to control air induction port 240. Exhaust poppet sleeve valve 241 is reciprocally disposed in power cylinders 242; said valve 241 is spring biased to the closed position to control coaxial exhaust port 243 and it actuated in positively timed relation. Upon closing of exhaust port 243, after completion of the upstroke of the power piston with some space remaining above said piston, air induction valve 239 is opened, as well as charge admission valve 218, both equally pressurized. A blanket of air will be laid around the freshly admitted charge, resulting in highly stratified charging. Upon ignition of the charge, mainly trapped in the small bore for head 215, the coaxial curtain of air surrounding the charge will insulate the charge from the cool metal enclosure walls and piston crown, contributing to thermal efficiency.

It should be understood that by suitable alterations of radial power cam and valve cam profiles, the embodiments shown may be executed as two cycle or four cycle engines and these are therefore, included in the scope of this invention.

Figure 36:
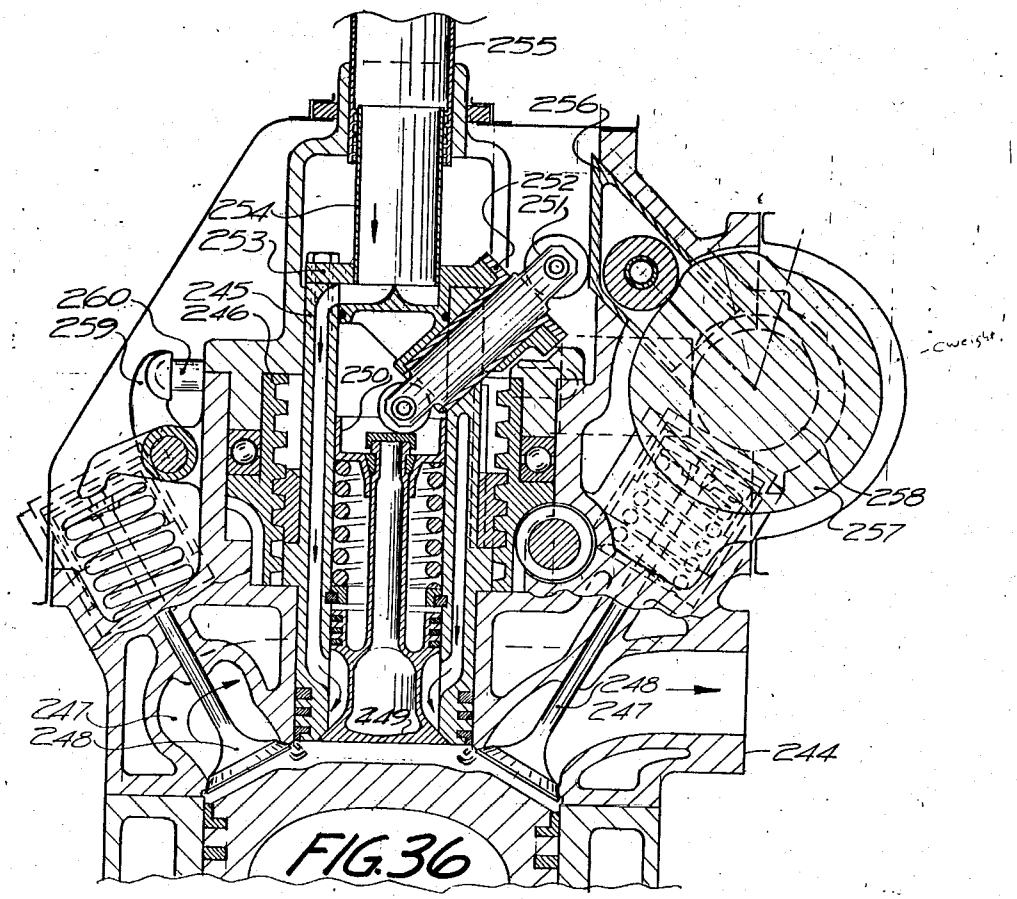
FIG. 36 shows an alternative cylinder head to the cylinder head shown in FIG. 33.

FIG. 36 shows an alternative cylinder head for radial power cam driven versions of this invention. Cylinder head 244 is provided with a small, central bore, coaxial with the power cylinder, to reciprocally dispose mini reciprocating head 245. A further coaxial counterbore disposes upper travel limiter 246. Surrounding said small central bore are two, three or four exhaust ports, symmetrically spaced and closed by conventional poppet type exhaust valves 248, arranged at an acute angle, to make room for upper travel limiter 246, coaxially about head 245. Only those components which are different from similar components shown and disclosed in FIG. 1 and FIGS. 24, 33, will be discussed. Charge admission valve 249 is one piece, with a fully closed head and provided with guide spool 250, to act also as a spring retainer. A hardened steel cap is trapped and disposed across the top of the hollow valve stem. Charge admission valve actuator 251, a cylindrical or square hollow body, with both ends bifurcated to carry rollers, is reciprocally carried at a 45 degree acute angle in a low friction bushing 252, by snorkel support base 253, a thin wall ferrous precision casting, cylindrically counterbored to slip over the end of the light alloy cast housing for mini recirpocating head 245. Said snorkel support base closes the center bore of head 245 and coaxially carries charge admission snorkel tube 254, which is reciprocally sealed in snorkel tube inlet section 255, which communicates with the charge pre-compressor. Valve actuator 251 is engaged by a vertical engaging surface on charge admission cam follower 256, a cylindrical piston shaped component with a bifurcated bottom skirt, internally carrying a cam follower roller. Said follower 256 is reciprocally carried at a 45 degree acute downward angle by cylinder head 244, and engages charge admission cam 257 provided on valve camshaft 258, which is rotatably carried by cylinder head 244 on an axis parallel to the mainshaft of the engine. For the embodiments shown in FIGS. 24, 26, 30, valve camshaft 258 runs at twice the engine speed, which gives a superior lobe-shape to the charge admission cam 257, said lobe providing extremely quick action. The bifurcated bottom skirt on cam follower 256 straddles cam 257, aiding in stabilizing cam follower 256 in its bore. Exhaust valves 248 are provided with hydraulic inverted bucket cam followers, actuated directly by exhaust cam lobes on valve cam shaft 258. Exhaust valves 248 on the opposite side of cylinder head 244 are actuated by rocker arms 259, operated by short horizontal pushrod 260, which is engaging a horizontal hydraulic cam follower, actuated by valve cam shaft 258. Ignition is by two conventional long tipped spark plugs with long tipped electrodes protruding well beyond the bottom edge of the bore for mini reciprocating head 245.

Figure 38:
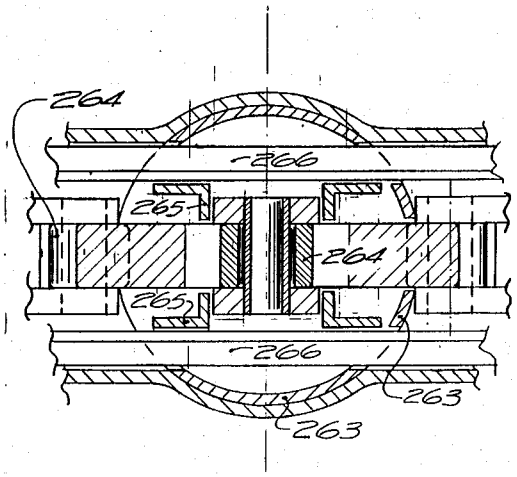
FIG. 38 is a section taken on plane P—P in FIG. 37.
Figure 37:
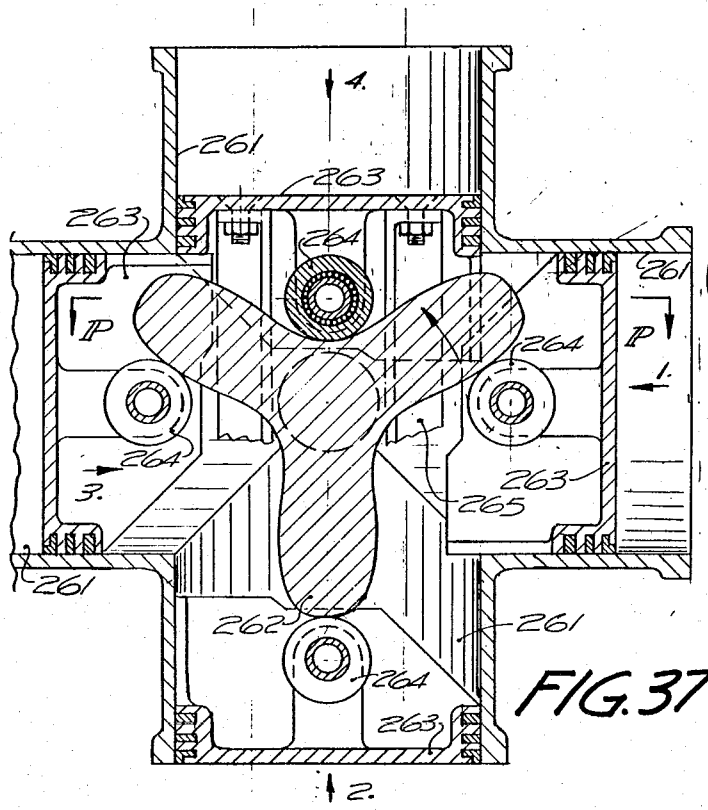
FIG. 37 shows a transverse cross section of a novel radial cam operated four cylinder expansion engine, intended as the second stage of compound gas expansion versions of this invention.

FIG. 37 shows the novel principle of FIG. 31, namely two solidly connected rollers engaging a uniform equal acceleration and decelleration radial cam in an out of phase step, applied to a four cylinder three lobed radial cam driven, single row radial cylinder engine. This embodiment is intended as second stage engine of a compound expansion internal combustion engine, although it may be used as a gas expansion engine for any cycle, such as the Rankin or Brayton Cycles, or as an air motor, or as a solid fluid displacement motor, or as a gas compressor or as a positive fluid displacer such as a pump. As such, these applications are included in the scope of this invention. Internal combustion engines of positive displacement variety may be be built as positive total exhaust expulsion engines, whereby all exhaust gasses are positively expelled practically 100%. These positively expelled exhaust gasses may be expelled under pressures of from 100 to 20 pounds psig, resulting in approximately 8% power loss, on the average, depending on many factors. The expelled gasses may be expanded to practically atmospheric pressure in a compact, extremely large displacement engine such as shown in FIG. 37. Cylinders 261 are radially arranged on a single common radial plane, at 90 degree (ninety deg) spacing, to form a four cylinder, single row, radial cylinder engine. Concentrically carried radial cam is provided with three deep stroking lobes designed to accelerate and decelerate pistons 263 at equal and uniform rates; equal downhill and uphill rates. The profile is compensated to allow for the diameter of cam rollers 264, said rollers 264 carried rotatably on pins supported by two internal roller support towers extending downward from the crown of the piston. In certain applications such as Rankin engines, or air motors, pistons 263 may be free pistons, with the fresh gas admitted before the piston reaches the top dead center during the upward expulsion stroke. In other applications, pistons 263 may be solidly connected together by four L-shaped tie rods 265, designed to clear the web of the radial cam 263, cam rollers 264 and said internal roller support towers, with the second set of tie rods 266 spaced apart to clear the first set of tie rods 265. This is clearly shown in FIG. 38. Tie rods 265, 266 may be bolted to the piston crowns and shimmed to remove all play in roller engagement. Any valving means may be applied to control fluid movement in and out of this embodiment. The engine requires three piston strokes per revolution and pistons apply power in sequence as shown by the arrows 1, 2, 3, 4, indicated. Power impulses are overlapping, while one piston is always in a power delivery position, resulting in full starting torque at zero speed. Pistons 263 have deep skirts on the thrust side.

Figures 39, 40:
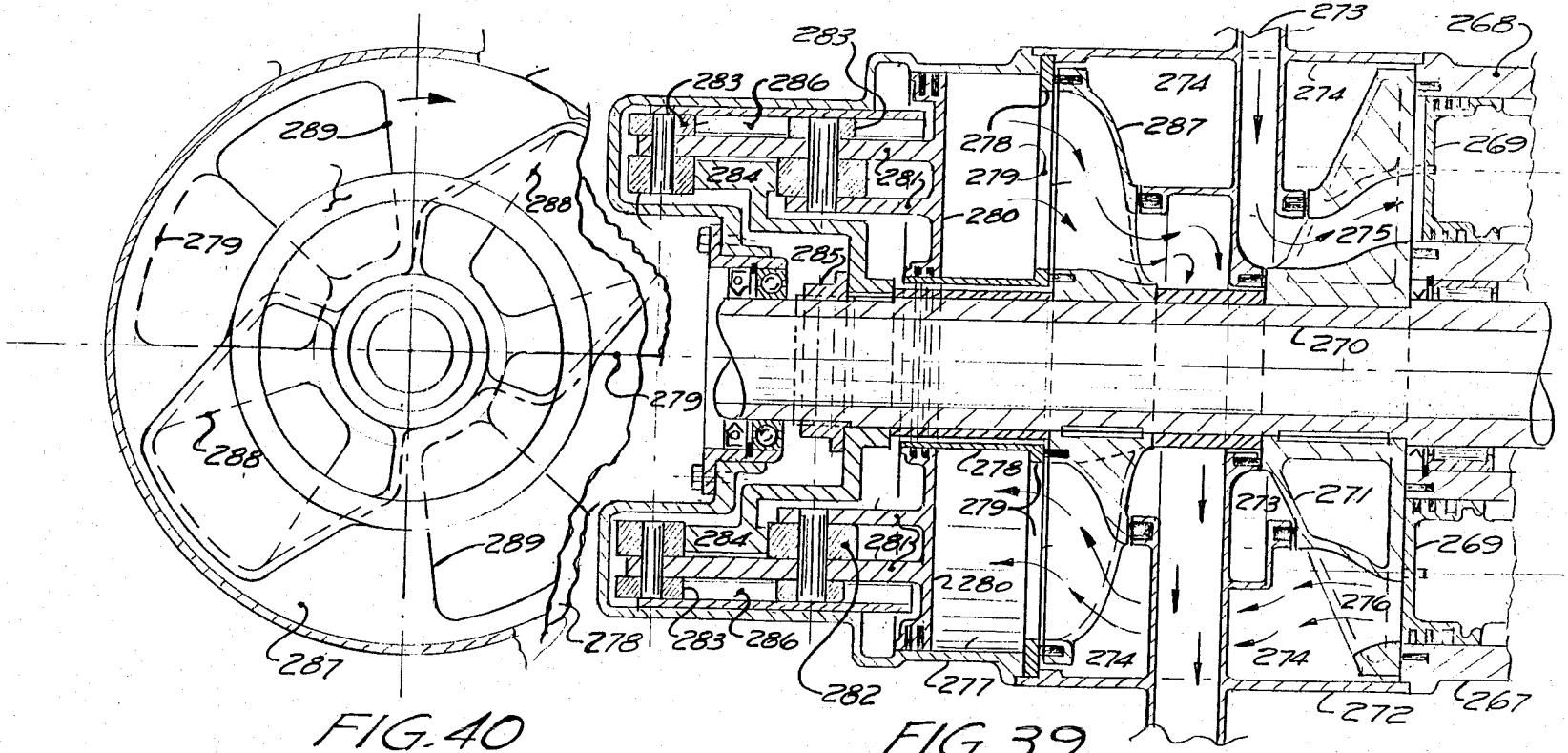
FIG. 39 is a cross section taken on the longitudinal centerplane of a rotor valve equipped axial power cam operated axial piston engine version of the invention, and shows a novel axial cam operated, coaxial axial piston, second stage of a compound gas expansion version of the invention.
FIG. 40 is a transverse cross section of the engine shown in FIG. 39 showing a "plan" view of the rotor valve controlling the aspiration of the second stage piston.

An axial cam driven version of a second stage of a compound expansion engine is shown in FIGS. 39 and 40. Reference may be made to our co-pending Canadian application No. 378-226-3; filed 81-05-25; for a description of a positive total exhaust expulsion, rotor valve equipped, axial piston, axial cam driven internal combustion engine for use with the embodiment shown in FIG. 39. Axial piston axial cam engine 267 comprises—an annular cylinder block 268, with pistons 269 reciprocally disposed in cylinders annularly and symmetrically arranged around main shaft 270, carried rotatably in said engine. The axial cam of engine 267 is mounted on main shaft 270 below pistons 269 and is profiled to reciprocate pistons 269 over four strokes for every revolution, said four strokes comprising the four strokes of the four cycle process. Rotor valve 271 comprises an extremely sturdy disc mounted on main shaft 270 and completely covering the open top ends of the cylinders, to form combustion chambers therein. Rotor valve 271 is disposed in Rotor valve housing which is divided in two coaxial compartments, charge inlet tunnel 273 and exhaust tunnel 274. The charge inlet tunnel 273 is sealed by coaxial seals bearing on coaxial annular faces on rotor valve 271 and communicates continuously with charge inlet port 275 in rotor valve 271, said port 275 being of such extent as to open communication between inlet tunnel 273 and the combustion chamber during the intake stroke of said engine. The cylinder cycles and related ports rotate in sequence. Similarly, exhaust port 276 opens communication for cylinders which are exhausting, to dump the exhaust gasses into the exhaust tunnel 274. The profile on the axial cam is designed to carry the piston 269 closely to the bottom of rotor valve 271, positively expelling a maximum of exhaust gasses under pressure. Exhaust tunnel 274 acts as a storage tank and interior exposed surfaces are insulated.

The second stage expansion section of said engine comprises a single annular coaxial cylinder, expansion cylinder 277, said cylinder 277 having an integral central coaxial cylindrical sleeve surrounding main shaft 270, said sleeve being an integral extension of ported cylinder head 278, a thin flat annular disc, provided with two opposed segmental wedge shaped head ports 279. Reciprocally disposed in expansion cylinder 277 is expansion piston 280, a broad annular flat topped piston with a coaxial hole to surround said cylindrical sleeve surrounding main shaft 270. Expansion piston 280 is provided with two or more bifurcated legs 281, which support main rollers 282 and guide rollers 283 on short pins. Main rollers 282 trap a profiled cylindrical axial cam 284 which is mounted on main shaft 270 by means of splines and secured by nut 285. The number of axial lobes on axial cam 284 equals the number of main roller sets, or multiples thereof. E.g., two main roller sets may operate on a two lobed or a four lobed axial cam. The illustrated embodiment has two lobes. Guide rollers 283 are reciprocally trapped in guideways 286, which are parallel to the axis of the engine. Expansion rotor valve 287 comprises a disc shaped casting with a flat bottom surface closely mating with the flat top surface of ported cylinder head 278. Inlet ports 288 match head ports 279 and allow communication between the expansion cylinder 277 and exhaust tunnel 274 during the initial portion of the downstroke of expansion piston 280. Outlet ports 289 similarly match head ports 279 and allow communication between the expansion cylinder 277 and outlet tunnel 290 during the upstroke of said expansion piston 280. FIG. 40 shows a top view of expansion rotor valve 287. Guide ways 286 and guide rollers 283 may be replaced by axially acting splines to react axial cam torque and prevent rotation of expansion piston 280. Sets of main rollers 282 may be replaced by a single main roller engaging an axially profiled groove in the cylindrical surface of axial cam 284.

Two cycle versions of the invention have a single stage low pressure compressor to provide low pressure scavenging air for the scavenging cycle carried out during the bottom portion of the piston stroke. Exhaust ports may be 360 degrees, in the cylinder walls, in the bottom of the expansion chamber, exposed with the piston in the bottom position; piston skirts are long enough to keep these ports covered when in the top position and pistons preferably carry the oil ring at the bottom of the skirt; not being subjected to piston side thrust, when using the novel thrust radius arms of this invention, little lubrication of the cylinder walls is required. Preferably the low pressure scavenging flow is divided in two streams before induction into the cylinder, a fuel charged stream, led to the charge admission valve, and a pure air scavenging stream led to a second fresh air induction valve resulting in highly stratified charging, with an insulating blanket of fresh air surrounding and preceding the admission of the fuel charged stream. This is illustrated in FIG. 35. A further refinement involves a second induction of fuel and air just after the exhaust ports are closed, the first induction being pure scavenging air induced with the piston in the bottom position and exhaust ports open. Said second induction would vary to vary power output and would be directed to remain in close vicinity of the spark plug. The upper travel limiter is automatically adjusted to suit in an approximately linear relationship with the total charge admitted, so that, under all power outputs, the combustion chamber volume is such that maximum permissible charge compression takes place.

While the invention has been disclosed by a number of specific embodiments it should be understood that numerous changes may be made to the disclosed details without departing from the spirit and scope of the inventive concepts involved. Accordingly, the invention is not intended to be limited by the disclosure but rather to have the full scope permitted of the following claims.

It should be understood that the mini reciprocating head disclosed for this invention need not reciprocate, but may be engaged by the upper travel limiter continuously, so that the axial movement of said mini reciprocating head directly follows the axial adjustment of the upper travel limiter. Exhaust gasses would not be expelled 100%; the exhaust gasses trapped in the bore of the mini reciprocating head would form an insulating blanket on top of the power piston and against the cylinder walls, after charge admission or induction, and would aid to reduce peak temperatures to control nitrous oxides. This arrangement is included in the scope of this invention.

FIG. 1 discloses an axially engaged poppet type exhaust valve, with the exhaust cam being an axially profiled, coaxial, annular cam surface provided on the bottom surface of a radially disposed disc, mounted on the protruding end of the engine's main shaft. The radially disposed disc may carry a second axially profiled, coaxial, annular cam surface to engage a second conventional poppet valve, to replace the mini reciprocating head in FIG. 1, said second valve comprising the intake valve of a four cycle, axial piston engine. Axially oriented, poppet valves, engaged by axially profiled coaxial valve cams are included in the scope of this invention.

Referring to FIG. 1, it should be understood that item 42, travel limiter drive shaft is employed in duplicate, each shaft engaging two upper travel limiter sleeves 39, with shafts 42 geared together, and driven by a rotary power actuator, which is controlled by the throttle (power output regulator) of the engine.

Two cycle versions of the engine in FIG. 1 may have exhaust ports, and eliminate the exhaust valve; a single stage charge low pressure compressor would be employed instead of the two stage version shown for novel three cycle versions of the invention.

The embodiments of the invention in which an exclusive property or privilege is claimed are defined as follows:

1. In an internal combustion engine having a separate compressor for compressing an air charge to a fixed precombustion pressure, a cylinder block having a number of cylinders with a number of pistons, one piston in each cylinder, said pistons operatively connected to cause rotation of a shaft rotatably supported in said block with movement of said pistons, and a cylinder head means secured to said block to close said cylinders, said cylinder head means including cylinder heads associated with and closing each cylinder and freely moveable between a fixed end position and an adjustable end position, each cylinder head sliding within a bore of said cylinder head means to vary a volume of a combustion chamber defined between each cylinder head and the piston in said associated cylinder, each cylinder head including an admission port communicating with said cylinder and said separate compressor for admission of said air charge into said combustion chamber, an admission valve for closing of said admission port, and an admission valve mechanical actuator including a connecting means moveable with each cylinder head and in engagement with a cam actuated valve control mechanism secured in said cylinder block for opening of said admission port by movement of said admission valve determined by said cam actuated valve control mechanism, said admission valve when seated with said admission port causes said cylinder head to move to said fixed end position due to a pressure bias created by said air charge prior entry into said cylinder and exerted on said cylinder head as said piston moves toward said cylinder head in an exhaust stroke to increase positive exhaust, said adjustable end position of said cylinder head defining a desired combustion chamber volume, said cylinder head being biased to move to said adjustable end position by said compressed charge when said admission valve is open, said fixed end position being determined by a stop face provided in said bore for engagement with a stop face provided on said cylinder head, said adjustable end position being determined by a mechanical actuator provided with a stop face for contact with a further stop face of said cylinder head, said mechanical actuator adjusting the position of the stop face thereof which determines said desired combustion chamber volume, the power output of said engine being controlled by controlling said mechanical actuator by means of adjusting said combustion chamber volume.

2. In an internal combustion engine as claimed in claim 1, said cam actuated valve control mechanism including an enlarged roller engaging face, said connecting means including an arm pivotally secured to said cylinder head and in engagement with a roller secured to said arm, said enlarged roller engaging face being of a size to accomodate movement of said cylinder head between said fixed end position and said adjustable end position and maintain said admission valve in timed relation with said piston.

3. In an internal combustion engine including a cylinder block, having four cylinders annularly arranged in parallel around a common axis, a piston in each cylinder, a main shaft rotatably supported on said common axis, and provided with an axially profiled lobed power cam, piston connecting means for each piston to impart rotary motion of said main shaft including a main roller engaging said power cam, a main roller pin rotatably supporting said main roller, said main roller pin carried by and cantilevered from an end of a thrust radius arm, said arm oriented in direction of torque reaction of said power cam and pivotally supported on a fixed thrust radius arm pivot pin, said pivot pin located on an axis which is parallel to said main roller pin, said piston connecting means further including a piston connecting link, comprising a bifurcated fork straddling said main roller and pivotally connected to said piston, and a cam follower roller rotatably carried by an inward protruding end of said main roller pin, said cam follower roller engaging a second axially profiled surface of said power cam, said second profiled surface acting to cause said piston to move with rotational movement of said power cam, a static cylinder head, closing said cylinders, including an exhaust port for each cylinder located inward of a center line of the cylinder, said exhaust port closed by an axially oriented poppet type exhaust valve, said valve reciprocally carried by said static cylinder head and urged to a closed position by a spring means, said exhaust valve actuated by a coaxially carried inverted bucket hydraulic cam follower, said static cylinder head further including an axially oriented bore associated with each cylinder having a mini reciprocating cylinder head therein, each bore located offset from a center line of said associated cylinder, each mini reciprocating head including a charge admission valve actuated by a charge admission valve actuator which is reciprocally carried by said mini reciprocating head at an upward angle of approximately 135 degrees relative to the center line of said associated cylinder, a travel limiter for each mini reciprocating cylinder head, coaxially mounted around an upward end of said mini reciprocating head, each travel limiter comprising a travel limiter sleeve, internally threaded and rotatably carried by said static cylinder head, each sleeve provided with engaging means for simultaneous synchronized engagement thereof, each travel limiter further comprising a non rotatable travel limiter ring, coaxially mounted on said mini reciprocating cylinder head within said travel limiter sleeve, to limit axial travel of said upward end of said mini reciprocating cylinder head, each ring provided with external threads matching and mating with said internally threaded travel limter sleeve, said mini reciprocating cylinder head including a travel limit ledge engaging said travel limiter ring, wherey limited rotation of said travel limiter sleeve in either direction will result in linear displacement of said travel limiter ring, within limits, and whereby engagement of said travel limit ledge with said travel limiter ring determines the initial volume of a combustion chamber of each of said cylinders, a combined valve cam drum, comprising a cylindrical open topped drum provided with a coaxial shaft like extension on a closed bottom end thereof, said drum coaxially rotatably supported in said engine, said shaft like extension splined coaxially into said main shaft, said drum including an axially profiled exhaust valve cam to actuate said exhaust valves, and provided with a radially profiled charge admission valve cam on an outside cylindrical surface of said drum, said charge admission valve cam being broad enough to accommodate limited axial displacement of said charge admission valve actuator as said actuator moves with said mini reciprocating cylinder head and maintain a timed relationship between said pistons and said charge admission valves, said combined valve cam drum further including an internal coaxial, axially profiled raceway for a charge pre-compressor reciprocator drum, said charge reciprocator drum comprising an open-topped cylindrical drum, coaxially and reciprocally disposed in said combined valve cam drum, said reciprocator drum provided with four cantilevered reciprocator shafts, which protrude from an outside cylindrical surface and each rotatably carrying a reciprocator roller, said roller engaging said coaxial axially profiled raceway, said charge reciprocator drum further including axially oriented internal splines on an internal cylindrical surface, said splines matching and mating with external splines coaxially provided on a first stage lower cylinder head of a charge pre-compressor, said splines allowing axial reciprocative displacement of said reciprocator drum and preventing rotational movement of same, whereby rotation of said combined valve cam drum will result in reciprocative motion for said charge reciprocator drum, said reciprocator drum further carrying a coaxial charge pre-compressor piston rod, a first stage pre-compressor cylinder, coaxially mounted to said static cylinder head, including a first stage piston, a second stage pre-compressor cylinder coaxially mounted to said first stage pre-compressor cylinder, including a second stage piston, with both said first stage piston and said second stage piston mounted on said pre-compressor piston rod, an inter-cooler, coaxially disposed, in a cooling jacket of said first and second pre-compressor cylinders, an after-cooler, coaxially disposed, in the cooling jacket for the pre-compressor cylinders, charge admission snorkel tubes for each mini reciprocating cylinder head, said charge admission snorkel tubes being statically carried in said engine and slidably engaging each mini reciprocating cylinder head for carrying a pre-compressed air charge from the after-cooler to each mini reciprocating cylinder head, an ignition means, a fuel supply means.

* * * * *